US008944426B2

(12) United States Patent
Kasuga et al.

(10) Patent No.: US 8,944,426 B2
(45) Date of Patent: Feb. 3, 2015

(54) SHEET PROCESSING APPARATUS AND IMAGE FORMING SYSTEM

(75) Inventors: Akio Kasuga, Tokyo (JP); Tatsuya Katagiri, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 10 days.

(21) Appl. No.: 13/564,819

(22) Filed: Aug. 2, 2012

(65) Prior Publication Data

US 2013/0038012 A1 Feb. 14, 2013

(30) Foreign Application Priority Data

Aug. 9, 2011 (JP) ..... 2011-174138
Aug. 10, 2011 (JP) ..... 2011-174828

(51) Int. Cl.

| | |
|---|---|
| ***B65H 37/06*** | (2006.01) |
| ***B41L 43/02*** | (2006.01) |
| ***B65H 31/34*** | (2006.01) |
| ***B65H 39/10*** | (2006.01) |
| ***B42C 1/12*** | (2006.01) |
| *B42B 4/00* | (2006.01) |

(52) U.S. Cl.

CPC ..... *B41L 43/02* (2013.01); *B65H 31/34* (2013.01); *B65H 39/10* (2013.01); *B42C 1/12* (2013.01); *B65H 2301/436* (2013.01); *B65H 2701/1123* (2013.01); *B65H 2801/27* (2013.01); *B42B 4/00* (2013.01)

USPC ..... 270/37; 270/32; 270/45; 270/52.18

(58) Field of Classification Search

USPC ..... 270/32, 37, 39.06, 39.07, 39.08, 45, 270/52.18

See application file for complete search history.

(56) References Cited

U.S. PATENT DOCUMENTS

| | | | | |
|---|---|---|---|---|
| 2,066,620 | A * | 1/1937 | Grammer | 281/27.3 |
| 2,088,904 | A * | 8/1937 | Grammer | 281/15.1 |
| 4,592,651 | A * | 6/1986 | Oikawa et al. | 355/72 |
| 5,377,965 | A | 1/1995 | Mandel et al. | |
| 5,501,442 | A | 3/1996 | Mandel | |

(Continued)

FOREIGN PATENT DOCUMENTS

| | | |
|---|---|---|
| JP | 7-179262 | 7/1995 |
| JP | 09-278275 | 10/1997 |

(Continued)

OTHER PUBLICATIONS

Japanese Office Action, Notification of Reasons for Refusal, Patent Application No. 2011-174138, Dispatch Date: Oct. 15, 2013 (3 pages).

(Continued)

*Primary Examiner* — Patrick Mackey
(74) *Attorney, Agent, or Firm* — Lucas & Mercanti, LLP

(57) ABSTRACT

A sheet processing apparatus 3 includes a position aligning section (61A, 61B), a holding section 53, and a processing section (38, 55). The position aligning section (61A, 61B) abuts the inner side or a fold of a sheet bundle (S2), which is formed by collecting a plurality of folded sheets (S1), to align the position of the folds of line plurality of folded sheets (S1). The holding section (53) holds the sheet bundle (S2) in which the position of the folds of the plurality of sheets (S1) has been aligned by the position aligning section (61A, 61B). The processing section (38, 55) performs a predetermined process on the sheet bundle (S2) held by the holding section 53.

14 Claims, 16 Drawing Sheets

(56) References Cited

U.S. PATENT DOCUMENTS

| | | | | |
|---|---|---|---|---|
| 6,817,605 | B1 * | 11/2004 | Bohn | 270/37 |
| 6,929,256 | B2 * | 8/2005 | Kawatsu et al. | 270/37 |
| 7,178,799 | B2 * | 2/2007 | Wakabayashi et al. | 270/39.06 |
| 8,146,906 | B2 * | 4/2012 | Sugihara | 270/52.18 |
| 2005/0008460 | A1 | 1/2005 | Watkiss | |
| 2006/0153612 | A1 * | 7/2006 | Saitsu et al. | 399/410 |
| 2010/0252983 | A1 * | 10/2010 | Sugihara | 270/58.08 |

FOREIGN PATENT DOCUMENTS

| | | |
|---|---|---|
| JP | 2004-115237 | 4/2004 |
| JP | 2006-36402 | 2/2006 |
| JP | 2006-110664 | 4/2006 |
| JP | 2009-202553 | 9/2009 |
| JP | 2009-227449 | 10/2009 |
| JP | 2011-11915 | 1/2011 |
| JP | 2011-025369 | 2/2011 |

OTHER PUBLICATIONS

English translation of Japanese Office Action, Notification of Reasons for Refusal, Patent Application No. 2011-174138, Dispatch Date: Oct. 15, 2013 (3 pages).

Japanese Office Action, Notification of Reasons for Refusal, Patent Application No. 2011-174828, drafting date: Oct. 30, 2013 (2 pages).

English translation of Japanese Office Action, Notification of Reasons for Refusal, Patent Application No. 2011-174828, drafting date: Oct. 30, 2013 (2 pages).

* cited by examiner

SHEET PROCESSING APPARATUS AND IMAGE FORMING SYSTEM

CROSS REFERENCES TO RELATED APPLICATIONS

The present invention contains subject matter related to Japanese Patent Application JP 2011-174138 and Japanese Patent Application JP 2011-174828 filed in the Japanese Patent Office respectively on Aug. 9, 2011 and Aug. 10, 2011, the entire contents of which being incorporated herein by reference.

BACKGROUND OF THE INVENTION

1. Field of the Invention

The present invention relates to a sheet processing apparatus and an image forming system having the sheet processing apparatus.

2. Description of the Related Art

An image forming system includes an image forming section for forming an image on a sheet and a sheet processing apparatus for performing various processing on the sheet on which the image is formed. The "various processing" performed by the sheet processing apparatus include, for example, a center folding processing, a trimming processing, a square back processing and the like, wherein the center folding processing is adapted to center-fold the sheet, the trimming processing is adapted to trim the end portion of a sheet bundle formed by a plurality of folded sheets, and the square back processing is adapted to transform the folded end portion of the sheet bundle into a square-shaped back surface.

Conventionally, when conveying the center-folded sheet bundle to a processing section where the trimming processing and the square back processing are performed, the sheet bundle is sandwiched so that the sheets are not out of alignment. Such conventional sheet processing apparatus is described in, for example, Japanese Unexamined Patent Application Publication No. H09-278275 (referred to as "Patent document 1" hereinafter). Patent document 1 proposes an art in which a pair of rollers are provided, and a sheet bundle is conveyed while an end portion of the sheet bundle is sandwiched by the pair of rollers.

Further, Japanese Unexamined Patent Application Publication No. 2011-25369 (referred to as "Patent document 2" hereinafter) proposes an art which includes a placing table on which a sheet bundle is placed, and a table moving mechanism for moving the placing table substantially in the horizontal direction. According to the art described in Patent document 2, the sheet bundle is placed on the placing table in a state where the planar portion of the sheets faces the placing table, and the placing table is moved substantially in the horizontal direction in a state where the sheet bundle is placed on the placing table, so that the sheet bundle is conveyed to a processing section which performs the trimming processing. Further, an end portion of the sheet bundle to be subjected to the trimming processing is sandwiched before performing the trimming processing.

A position control mechanism for controlling the position of the sheet bundle is described in, for example, Japanese Unexamined Patent Application Publication No. 2009-202553 (referred to as "Patent document 3" hereinafter). A post-processing device described in Patent document 3 conveys the center-folded sheet bundle in the horizontal direction in a manner in which the fold of the sheet bundle faces forward. Further, a protrusion amount regulating member abuts the outer side of the fold of the sheet bundle so as to regulate the position of the sheet bundle, and the square back processing is performed so that the folded end portion of the sheet bundle is transformed into a square-shaped back surface.

SUMMARY OF THE INVENTION

However, in the art disclosed in Patent document 1, due to the difference of the friction coefficients of the pair of the rollers used to convey the sheet bundle, individual variation in feed rate between the plurality of sheets of the sheet bundle was caused. Further, due to the individual variation in feed rate, misalignment of the center position of the fold of the sheet bundle was caused.

Further, in the art disclosed in Patent document 2, there is a concern that, when sandwiching the end portion of the sheet bundle, the end portion of the sheet bundle might jump up or drop down. As a result, since the end portion of the sheet bundle lumps up or drops down, the center position of the fold of the sheet bundle will be oat of alignment, and therefore when performing the trimming processing and the square back processing, trimming misalignment and square back misalignment will be caused.

Further, in the post-processing device described in Patent document 3, since the protrusion amount regulating member abuts the outer side of the fold of the sheet bundle so as to regulate the position of the sheet bundle, if the sheet bundle is previously warped upward or downward, the position alignment of the sheet bundle will not able be performed accurately.

Particularly, in the case where the center-folded sheet bundle is conveyed in the horizontal direction by a belt or rollers, since the sheet bundle tends to be warped upward or downward due to the frictional force generated by touching with the belt or the like, accuracy of the position alignment of the sheet bundle will be decreased.

Further, in the case where gap(s) is generated between the folds of the plurality of sheets, which form the sheet bundle, superimposed on each other, since the gap(s) generated between the folds of the sheets superimposed on each other will not be eliminated even if a protrusion amount regulating member abuts against the outer side of the fold of the sheet bundle, the position of the sheet bundle can not be adjusted with high accuracy.

In view of the aforesaid problems with the prior arts, it is an object of the present invention to provide a sheet processing apparatus and an image forming system capable of preventing misalignment from occurring when aligning position of the fold of the sheet bundle to perform the trimming processing and the square back processing. Further, it is another object of the present invention to provide a sheet processing apparatus and an image forming system capable of adjusting the position of the sheet bundle with high accuracy according to various processing.

To solve the aforesaid problems and achieve the objects of the present invention, a sheet processing apparatus according to an aspect of the present invention includes a position aligning section, a holding section, and a processing section.

The position aligning section is adapted to be abutted against the inner side of a fold of a sheet bundle, which is formed by collecting a plurality of folded sheets, to thereby align the position of the folds of the plurality of folded sheets. The holding section is adapted to hold the sheet bundle in which the position of the folds of the plurality of sheets has been aligned by the position aligning section. The processing section is adapted to perform a predetermined process on the sheet bundle held by the holding section.

Further, an image forming system according to another aspect of the present invention includes an image forming section, a folding section, a position aligning section, a holding section, and a processing section.

The image forming section as adapted to form an image on a sheet. The folding section is adapted to fold the sheet supplied from the image forming section. The position aligning section is adapted to be abutted against the inner side of a fold of a sheet bundle, which is formed by collecting a plurality of folded sheets, to thereby align the position of the folds of the plurality of folded sheets. The holding section is adapted to hold the sheet bundle in which the position of the folds of the plurality of sheets has been aligned by the position aligning section. The processing section is adapted to perform a predetermined process on tine sheet bundle held by the holding section.

BRIEF DESCRIPTION OF THE DRAWINGS

FIGS. 3A to 3C are views showing a schematic configuration of a saddle stapling section of the sheet processing apparatus of the present invention; wherein FIG. 3A shows the schematic configuration of the saddle stapling section in a state where a first stapling process is performed, FIG. 3B shows the schematic configuration of the saddle stapling section in a state where a second stapling process is performed, and FIG. 3B shows the schematic configuration of the saddle stapling section in a state where the stapling processes have been completed;

FIGS. 16A to 16C are schematic views for explaining fold aligning operation of the sheet bundle in the sheet bundle holding mechanism shown in FIG. 8; wherein FIG. 16A is a schematic view showing a state where the sheet bundle has not been received yet, FIG. 16B is a schematic view showing a state where position alignment of the fold of the sheet bundle is being performed, and FIG. 16C is a schematic view showing a state where the sheet bundle has been held by a holding section.

DETAILED DESCRIPTION OF THE PREFERRED EMBODIMENT

Figure 1:
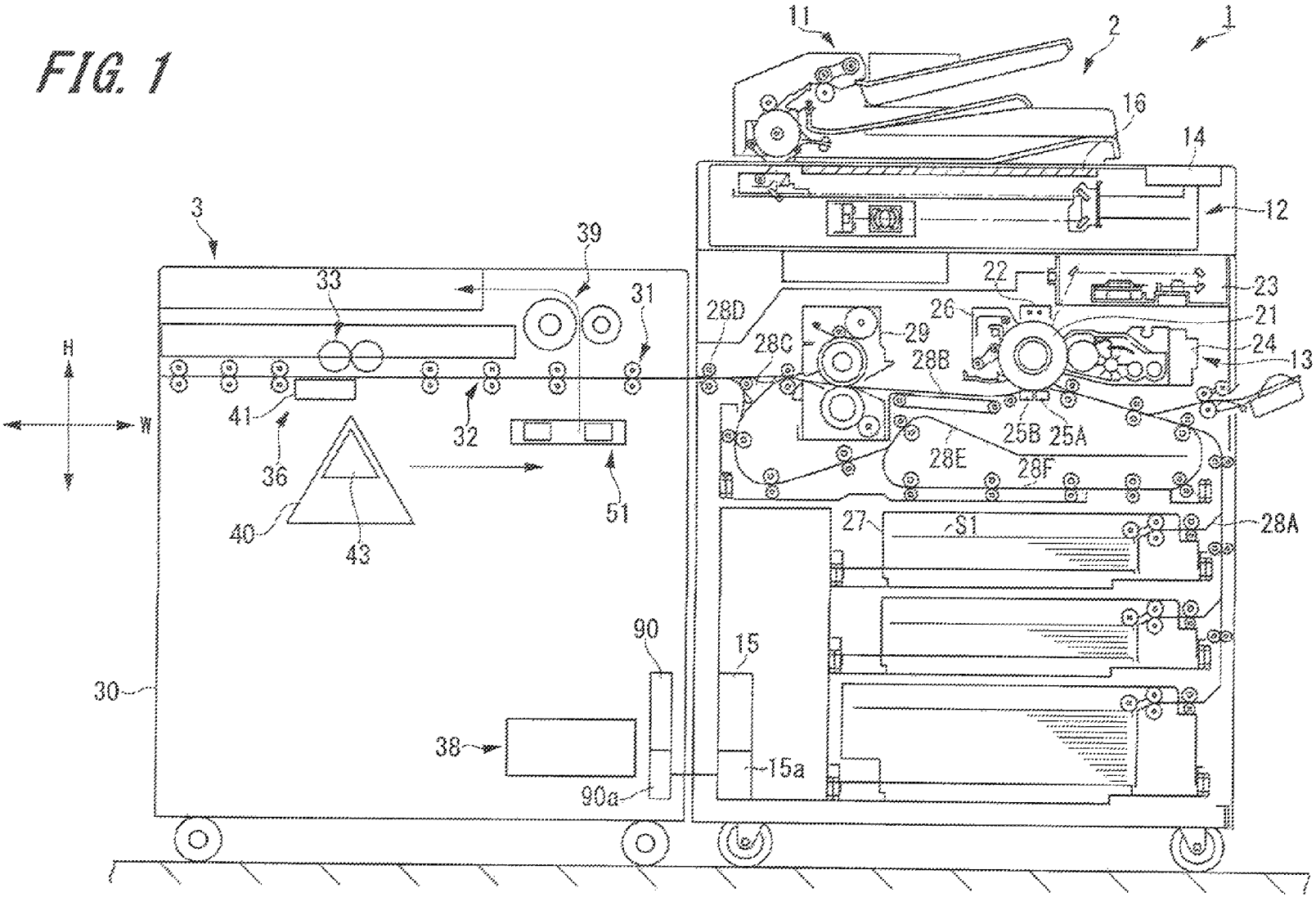
FIG. 1 is a view showing overall configuration of an image forming system according to an embodiment of the present invention.

An embodiment (referred to as "present embodiment" hereinafter) for carrying out a sheet processing apparatus and an image forming system of the present invention will be described below with reference to FIGS. 1 to 16C. In the drawings, like components are denoted by like reference numerals. Note that the description given in this column is not intended to limit the technical scope and meaning of the technical terms described in the claims of the present invention.

<Image Forming System>

First, an image forming system of the present embodiment will be described below with reference to FIG. 1.

FIG. 1 is a view showing overall configuration of an image forming system 1 according to an embodiment of the present invention.

As shown in FIG. 1, the image forming system 1 includes an image forming apparatus 2 and a sheet processing apparatus 3 connected to the image forming apparatus 2. The image forming apparatus 2 is a concrete example of an image forming section according to the present invention.

[Image Forming Apparatus]

First, the image forming apparatus 2 will be described below.

The image forming apparatus 2 is adapted to form an image on a sheet based on electrophotographic technology. The image forming apparatus 2 includes a document conveying section 11, an image reading section 12, an image forming section 13, an operation display section 14 and a controller 15.

Note that, although the image forming apparatus 2 described in the present embodiment is a device that forms the image based on electrophotographic technology, the image forming apparatus is nor limited thereto, but may also be a device that forms the image based on other technologies such as ink-jet technology, thermal transfer technology, silver halide photography technology and the like.

The document conveying section 11 conveys the document page by page to a reading position of the image reading section 12. The image reading section 12 reads the image of the document conveyed by the document conveying section 11 or the image of the document placed on a platen 16.

The image forming section 13 includes a drum-like photoreceptor 21, a charging section 22, an exposure section 23, a developing section 24, a transfer section 25A, a separating section 23B and a cleaning section 26, wherein the charging section 22, the exposure section 23, the developing section 24, the transfer section 25A, the separating section 25B and the cleaning section 26 are arranged around the photoreceptor 21. The charging section 22 evenly charges the surface of the photoreceptor 21. The exposure section 23 performs exposure scanning on the photoreceptor 21 to form a latent image based on image data read from the document. The developing section 24 reversely develops the latent image by depositing toner, so that a toner image is formed en the surface of the photoreceptor 21.

The sheet S1 is accommodated in a sheet accommodating section 27. The sheet S1 is fed by a sheet feeding section 28A and sent to a transferring position. The transfer section 25A transfers the toner image to the sheet S1 sent to the transferring position. The separating section 25B eliminates the charges on the reverse side of the sheet S1 to which the toner image has been transferred, and separates the sheet 31 from the photoreceptor 21. The sheet S1 separated from the photoreceptor 21 is conveyed to a fixing section 29 by an intermediate conveying section 28B. The fixing section 29 heat-fixes the toner image transferred to the sheet S1.

A changeover gate 28C is arranged on the downstream of the conveyance direction of the sheet 31 of the fixing section 29. The changeover gate 28C switches the conveying path of the sheet S1 passed through the fixing section 29. In other words, when ejecting the sheet with its face facing up in the case of forming image on one side of the sheet, the sheet S1 will be caused to go straight ahead. Therefore, the sheet S1 is ejected by a pair of sheet ejecting rollers 28D. Further, when ejecting the sheet with its face facing down in the case of forming image on one side of the sheet, or when forming images on both sides of the sheet, the sheet S1 will be guided downward.

When ejecting the sheet with its face facing down, after the sheet S1 have been guided downward, the conveyance direction of the sheet will be switched at the point when the back end of the sheet S1 has passed through the changeover gate 28C, so that the sheet S1 is ejected by the pair of sheet ejecting rollers 28D. Further, when forming images on both sides of the sheet, after the sheet S1 has been guided downward by the changeover gate 28C, the sheet S1 will be sent to a sheet reversal conveying section 28E. Further, the reversed sheet S1 is sent to the transferring position again through a sheet re-feeding path 28F.

The cleaning section 26 removes the developer remaining on the surface of the photoreceptor 21.

The operation display section 14 has a touch panel and the like. The operation display section 14 functions as an input section for the user to input job information to cause the image forming apparatus 2 and the sheet processing apparatus 3 to operate. With the operation display section 14, the user may perform input operation such as selecting size of the sheet, selecting number of sheets, and/or the like, as the job information. Further, the user may also select whether or not to perform stapling process with the sheet processing apparatus 3, and if yes, the user may input number of sheets to be stapled in the stapling process, as the job information. The job information inputted with the operation display section 14 is transmitted to the controller 15.

Further, the operation display section 14 has a start button. If the user presses the start button, the image forming apparatus 2 and the sheet processing apparatus 3 will start operations associated with the job information inputted by the operation display section 14.

The controller 15 controls image forming operation of the image forming apparatus 2 based on the received job information. Further, a communication section 15*a* of the sheet processing control circuit 30 is electrically connected to a communication section 90*a* of the sheet processing control circuit 90 of the sheet processing apparatus 3, so that a serial communication is performed between the controller 15 and the sheet processing control circuit 90. Further, the sheet processing control circuit 90 controls the sheet processing apparatus 3 so that the sheet, processing apparatus 3 operates in conjunction with the image forming operation of the image forming apparatus 2.

[Sheet Processing Apparatus]

Next, the sheet processing apparatus 3 will be described below with reference to FIGS. 2 to 4.

Figure 2:
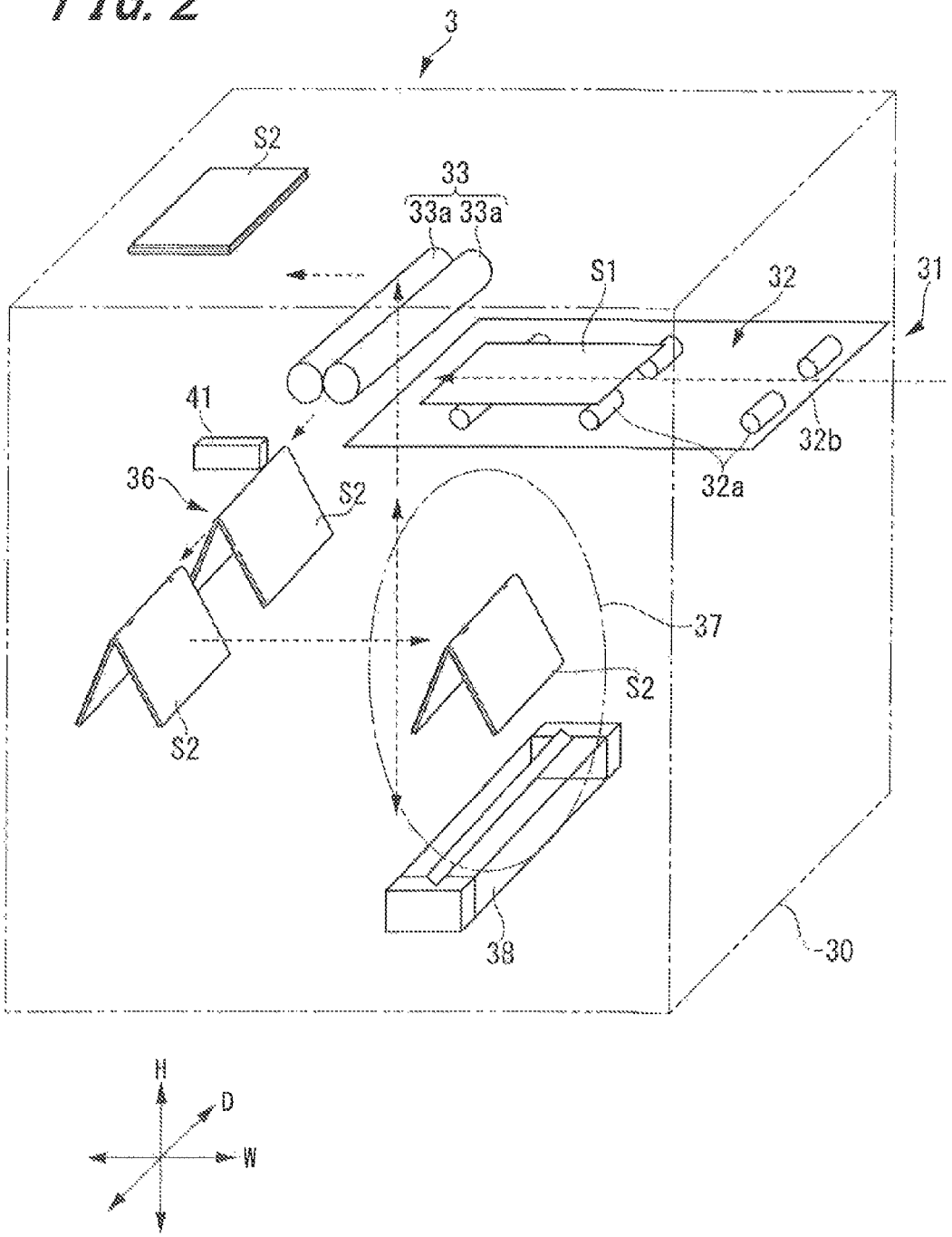
FIG. 2 is a view showing a schematic configuration of a sheet processing apparatus of the image forming system of the present invention.

FIG. 2 is a view showing a schematic configuration of the sheet processing apparatus 3.

The sheet processing apparatus 3 is adapted to perform various processing, such as stapling process, folding processing and the like, on the sheet supplied from the image forming apparatus 2.

As shown on FIG. 2, the sheet processing apparatus 3 includes a receiving section 31, a first sheet conveying section 32, a center folding section 33, a second sheet conveying section 31 (see FIGS. 3A to 3C), a saddle stapling section 36 and a composite processing section 37. The composite processing section 37 has a sheet bundle holding mechanism 51, a trimming section 38 and an ejecting section 39 (see FIG. 6).

Incidentally, the direction parallel to the horizontal direction of the sheet processing apparatus 3 and in which the image forming apparatus 2 and the sheet processing apparatus 3 are opposed to each other is defined as a "width direction W", the direction perpendicular to the width direction W and parallel to the vertical direction is defined as a "height direction H", and the direction perpendicular to both the width, direction W and the height direction H is defined as a "depth direction D".

The receiving section 31 is arranged on one side of the sheet processing apparatus 3 in the width direction W of the case 30. The receiving section 31 opens on a surface of the case 30 facing the image forming apparatus 2. The sheet S1 elected from the sheet ejecting rollers 28D (see FIG. 1) of the image forming apparatus 2 is inserted into the receiving section 31.

The first sheet conveying section 32 includes a plurality of rollers 32*a* driven by a motor (not shown) and a conveying path 32*b* extends along the width direction W. The first sheet conveying section 32 conveys the sheet S1 received by the receiving section 31 to the center folding section 33.

The center folding section 33 includes two folding rollers 33*a*, 33*a* and a folding plate (not shown), wherein the two folding rollers 33*a*, 33*a* are brought into pressure contact with each other. The two folding rollers 33*a*, 33*a* rotate in directions opposite to each other. The folding plate presses the sheet S1 so as to cause the center the sheet S1 to pass through between the two folding rollers 33*a*, 33*a*. Thereafter, the two folding rollers 33*a*, 33*a* reverse the rotation direction thereof, so that the sheet S1 is ejected to the below in the height direction H. Thus, the sheet S1 is folded in a state where the center thereof is convex up toward the height direction H, and thereby the center folding processing is completed.

Figure 3A:
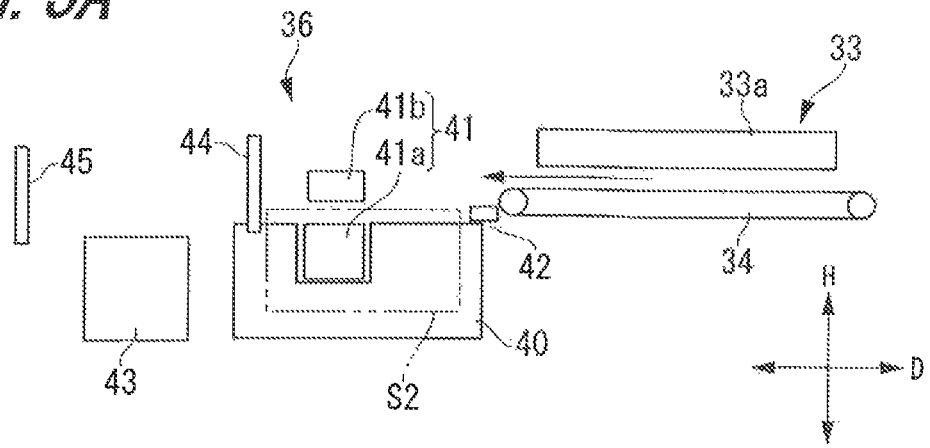
Figure 3B:
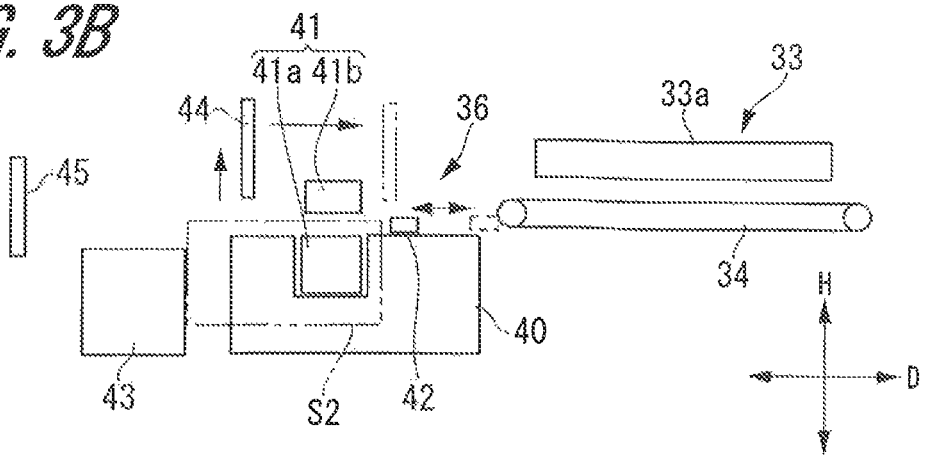
Figure 3C:
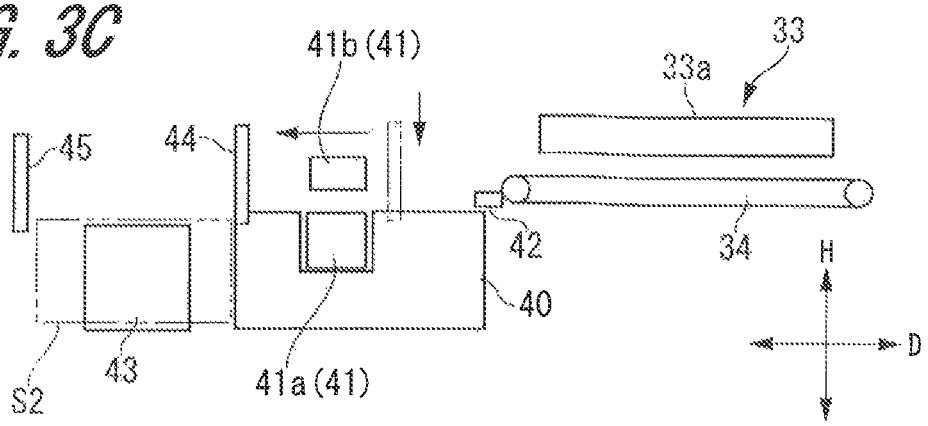

FIGS. 3A to 3C are views showing a schematic configuration of the saddle stapling section 36 of the sheet processing apparatus 3 viewed from the width direction W.

As shown in FIG. 3A, the second sheet conveying section 34 is arranged below two folding rollers 33*a*, 33*a* of the center folding section 31 in the height direction H. The second sheet conveying section 34 extends along the depth direction D. The second sheet, conveying section 34 conveys the sheet S1, which has been center-folded by the center folding section 33, to the saddle stapling section 36.

The saddle stapling section 36 includes a sheet collecting section 40, a stapling section 41, an aligning section 42 and a first stopper 44. The sheet collecting section 40 has a substantially triangular shape when viewed from the depth direction D, and an apex of the sheet collecting section 40 faces up in the height direction H. The inner side of the folded portion of the center-folded sheet S1 is placed on the apex of the sheet collecting section 40. In the sheet collecting section 40, a plurality of sheets S1 are collected, so that the sheet handle S2 is formed.

The stapling section 41 is arranged in the sheet collecting section 40. The stapling section 41 includes a staple-receiving mechanism 41*a* that is arranged inside the sheet collecting section 40, and a stapling mechanism 41*b* that faces the staple-receiving mechanism 41*a*. The staple-receiving mechanism 41*a* is movably supported by a supporting section (not shown) so that it can move in the height direction H. The stapling mechanism 41*b* is fixed above the sheet collecting section 40 in the height direction H (i.e., above the staple-receiving mechanism 41*a*) by an attaching member (not shown).

Further, the aligning section 42 and the first stopper 44 are arranged above the sheet collecting section 40 in the height direction H. The aligning section 42 is configured so that it can be moved in the depth direction D. The first stopper 44 is configured so that it can be moved in both the height direction H and the depth direction D. Further, a sheet bundle conveying section 43 is arranged on the downstream of the sheet collecting section 40 in the depth direction D. A second stopper 45 is arranged above the sheet bundle conveying section 43 in the height direction H. Incidentally, the detail configuration of the sheet bundle conveying section 43 will be described later.

The saddle stapling operation of the saddle stapling section 36 will be described below with reference to FIGS. 3A to 3C.

First, as shown in FIG. 3A, after a predetermined number of sheets S1 have been collected in the sheet collecting section 40 so as to form the sheet bundle S2, the aligning section 42 pushes the sheet bundle S2 against the first stopper 44 so that the position of the sheet bundle S2 is aligned. Next, the staple-receiving mechanism 41*a* of the stapling section 41 is raised to perform a first stapling process on the sheet bundle S2. At this time, the first stopper 44 is moved upward to a predetermined height in the height direction H.

As shown in FIG. 3B, when the first stapling process has been performed, the aligning section 42 is moved for a predetermined distance toward the downstream side in the depth direction D. Thus, the sheet bundle S2 is pushed to a position where a second stapling process is to be performed. Further, the staple-receiving mechanism 41*a* of the stapling section 41 is raised to perform the second stapling process on the sheet bundle S2.

While the second stapling process is being performed, the first stopper 44 is moved toward the side of the center folding section 33 in the depth direction D so as to be brought into a position above an end portion of the sheet bundle S2 on the upstream side. Further, the aligning section 42 is moved in the depth direction D so as to be evacuated to a predetermined position.

As shown in FIG. 3C, when the second stapling process has been performed, the first stopper 44 is lowered to a position facing the end portion of the sheet bundle S2 on the upstream side. Thereafter, the first stopper 44 is moved toward the side of the second stopper 45 in the depth direction D. Thus, the sheet bundle S2 is pushed by the first stopper 44, so as to be moved from the sheet collecting section 40 toward the sheet bundle conveying section 43. At this time, the sheet bundle S2 is pushed against the second stopper 45 so that the position of the sheet bundle S2 is aligned.

Incidentally, in the case where the saddle stapling is not to be performed, the stapling section 41 will not operate. Thus, when a plurality of sheets S1 have been collected in the sheet collecting section 40 to form the sheet bundle S2, the aligning section 42 and the first stopper 44 will push the sheet bundle S2 to move the sheet bundle S2 toward the sheet bundle conveying section 43.

Next, the sheet bundle conveying section 43 will be described below with reference to FIG. 4.

Figure 4:
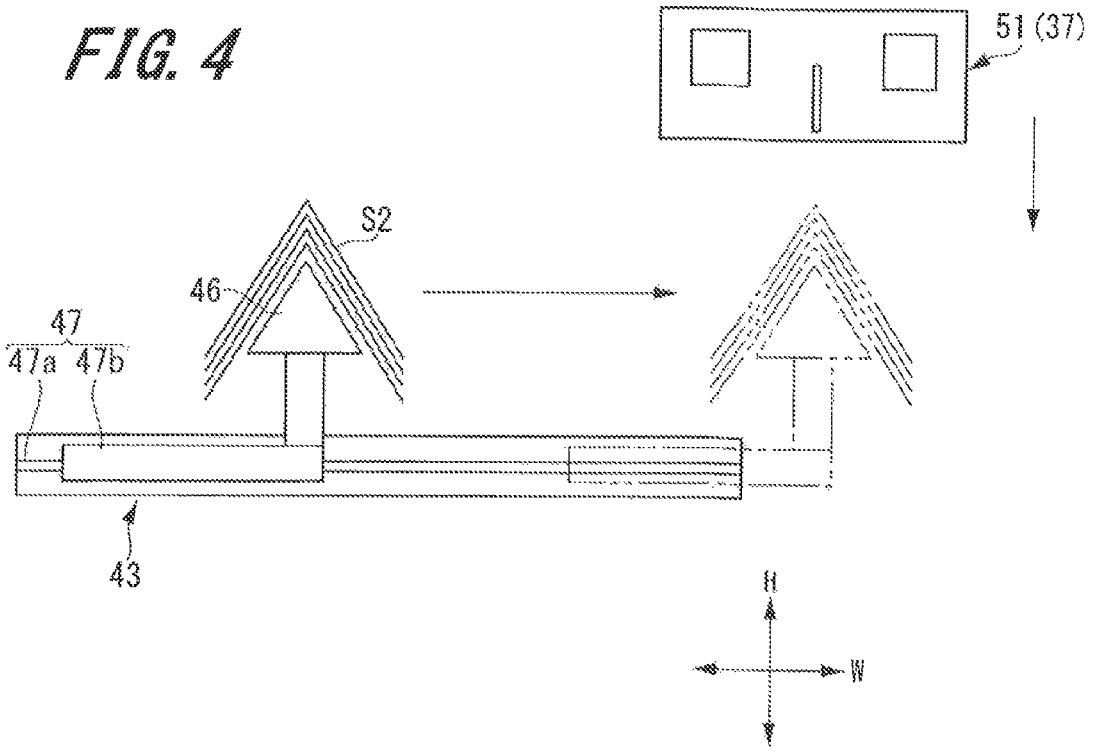
FIG. 4 is a view showing a schematic configuration of a sheet bundle conveying section of the sheet processing apparatus of the present invention.

FIG. 4 is a view showing a schematic configuration of the sheet bundle conveying section 43 of the sheet processing apparatus 3 when viewed from the depth direction D.

The sheet bundle conveying section 43 conveys the sheet bundle S2 received from the sheet collecting section 40 (see FIG. 3C) to a position immediately below the sheet bundle holding mechanism 51 of the composite processing section 37 in the height direction H. As shown in FIG. 4, the sheet bundle conveying section 43 has a sheet bundle placing member 46 and a sheet bundle moving mechanism 47.

Similar to the sheet collecting section 40 (see FIG. 1), the sheet bundle placing member 46 has a substantially triangular shape when viewed from the depth direction D, and an apex of the sheet bundle placing member 46 faces up in the height direction H. The sheet bundle placing member 46 is supported by the sheet bundle moving mechanism 47 so that it can move in the width direction W.

The sheet bundle moving mechanism 47 includes a slide rail 47*a*, a sliding member 47*b* and a drive section (not shown), wherein the slide rail 47*a* extends substantially parallel to the width direction W, the sliding member 47*b* slides against the slide rail 47*a* and supports the sheet bundle placing member 46, and the drive section drives the sliding member 47*b*. The sheet bundle S2 is conveyed by the sheet bundle conveying section 43 to the position immediately below the sheet bundle holding mechanism 51 of the composite processing section 37 in the height direction H.

[Composite Processing Section]

Next, the composite processing section 37 will be described below with reference to FIGS. 5 to 7.

Figure 5:
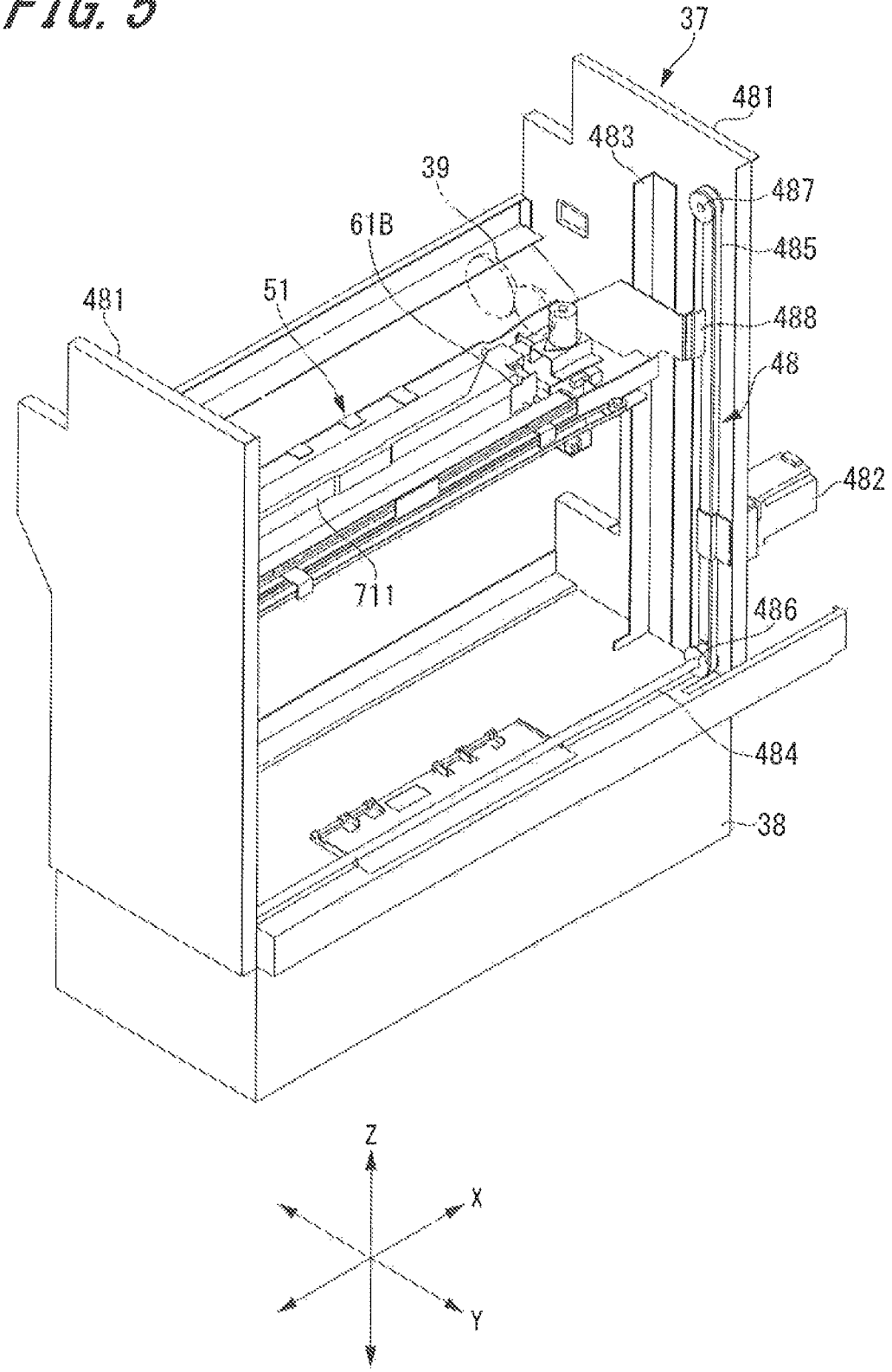
FIG. 5 is a perspective view showing a composite processing section of the sheet processing apparatus of the present invention.
Figure 6:
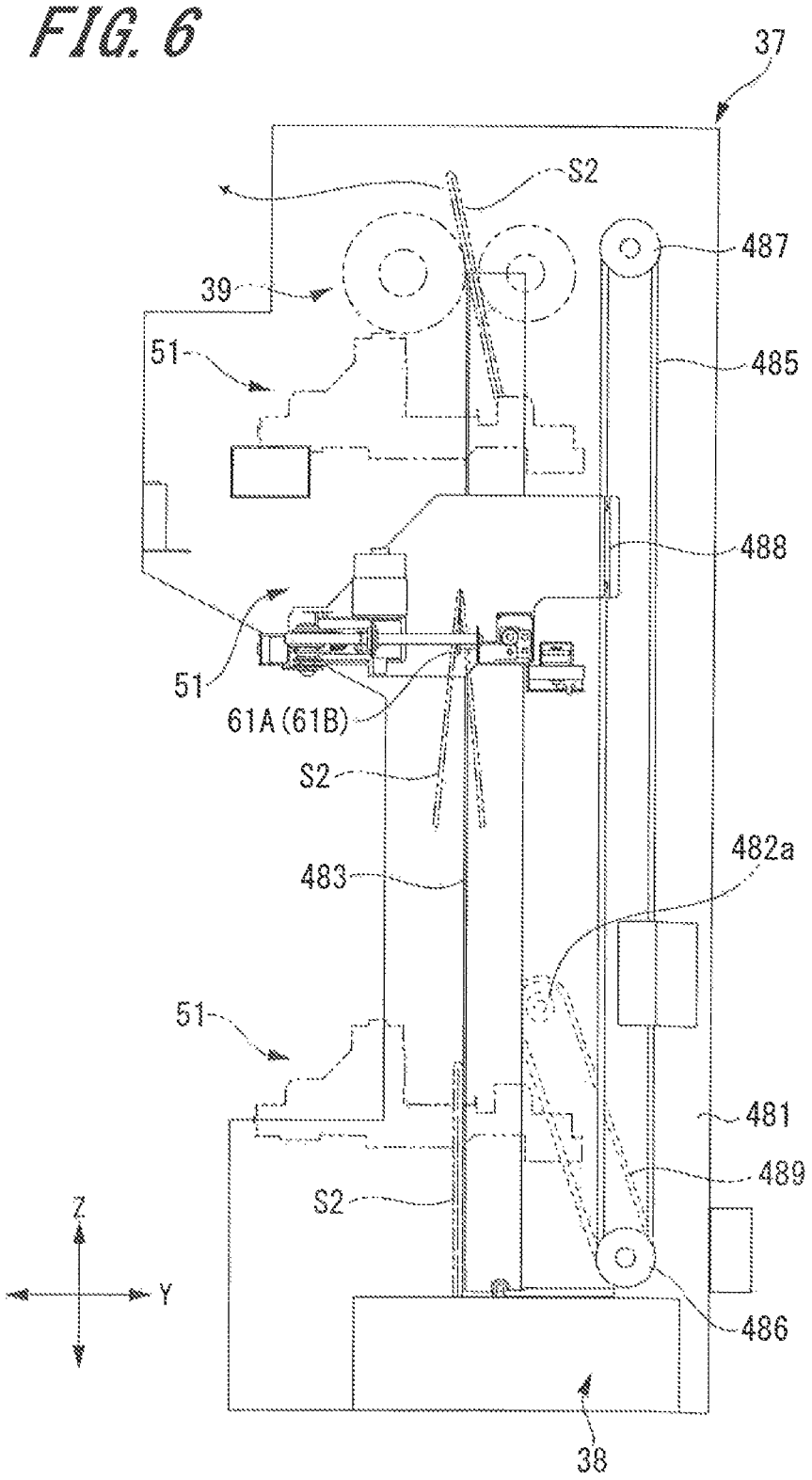
FIG. 6 is a side view showing the composite processing section of the sheet processing apparatus of the present invention.
Figure 7:
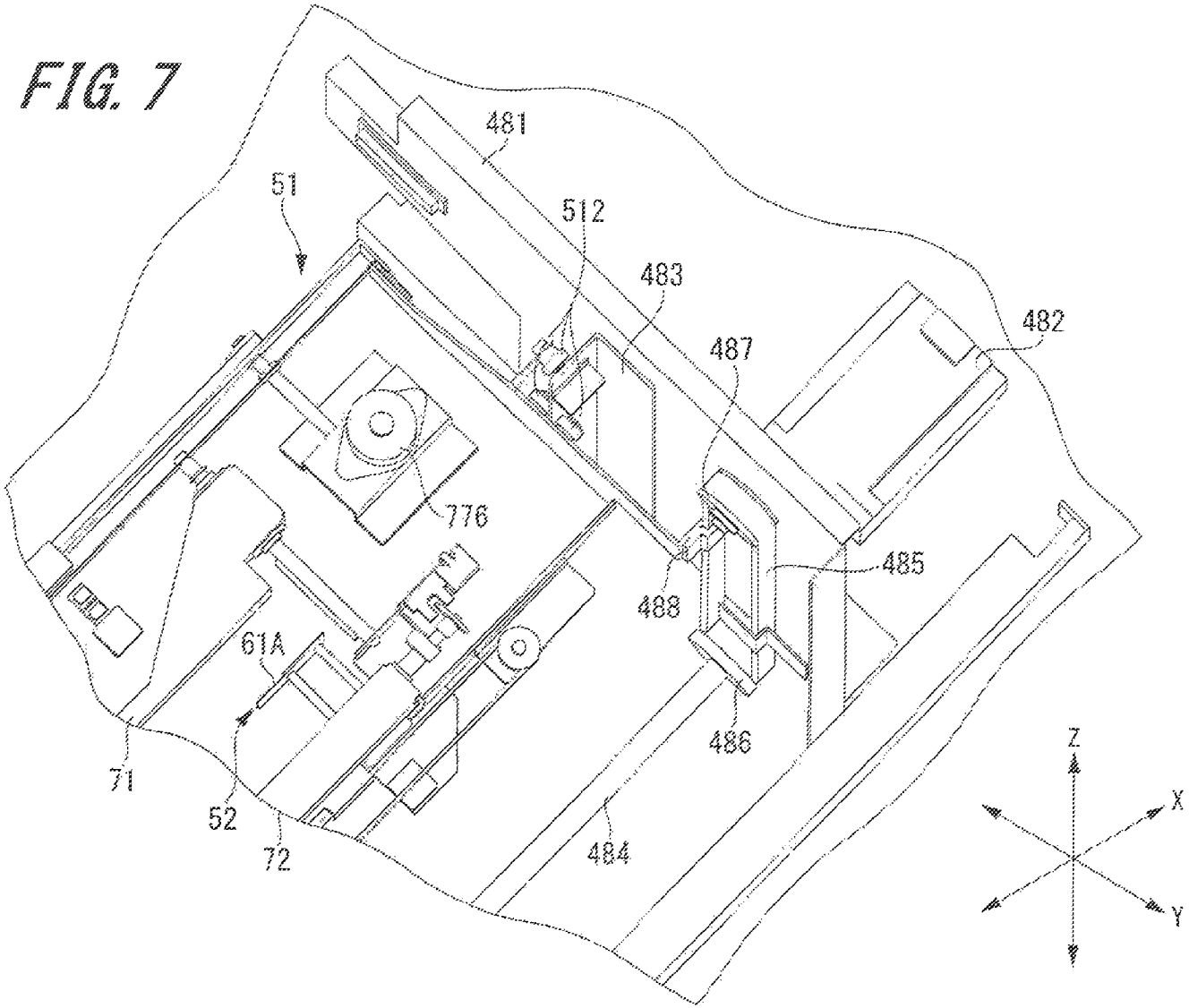
FIG. 7 is a perspective view showing a primary portion of the composite processing section of the sheet processing apparatus of the present invention.

FIG. 5 is a perspective view of the composite processing section 37, FIG. 6 is a side view of the composite processing section 37, and FIG. 7 is a perspective view showing a primary portion of the composite processing section 37.

As shown in FIGS. 5 and 6, the composite processing section 37 includes the sheet bundle holding mechanism 51, the trimming section 38, the ejecting section 39 and an elevating mechanism 48, wherein the sheet bundle holding mechanism 51 is adapted to hold the center-folded sheet bundle S2, the trimming section 38 is adapted to perform trimming processing on the sheet bundle S2, and the ejecting section 39 is adapted to eject the sheet bundle S2 having been subjected to various processing. Incidentally, in the drawings from FIG. 5, the direction in which a pressing portion 711 (which is to be described later) of the sheet bundle holding mechanism 51 moves is defined as a "first direction Y", the longitudinal direction of the pressing portion 711 is defined as a "second direction X", and the direction perpendicular to both the first direction Y and the second direction X and parallel to the vertical, direction is defined as a "third direction Z".

The elevating mechanism 48 supports the sheet bundle holding mechanism 51 so that the sheet bundle holding mechanism 51 can move up and down along the third direction Z. Incidentally, the elevating mechanism 48 also serves as a lifting mechanism of the present invention. Further, the ejecting section 39 is arranged above the elevating mechanism 48 in the third direction Z, and the trimming section 38 is arranged below the elevating mechanism 48 in the third direction Z.

The elevating mechanism 48 includes a pair of frames 481, an elevating drive motor 482, two guide rails 483, a drive transmission shaft 484, and two timing belts 485. The pair of frames 481 are arranged on both sides of the second direction X.

The pair of frames 481 each have a first pulley 486 rotatably mounted on the lower side thereof in the third direction 3 and a second pulley 487 rotatably mounted on the upper side of thereof in the third direction 2. Further, the drive transmission shaft 484 is attached to the two first pulleys 486 so as to connect the two first pulleys 486 arranged in the pair of frames 481.

Further, in each of the frames 481, the timing belt 485 (which is an endless belt) is wrapped around the first pulley 486 and the second pulley 487. A connecting portion 488 is fixed to each of the timing belts 485. Further, the sheet bundle holding mechanism 51 is fixed to the connecting portion 488.

As shown in FIG. 6, a drive transmission belt (which is an endless belt) 489 is wrapped around the first pulley 486 mounted on one of the pair of the frames 481 arranged on one side in the second direction X. The drive transmission belt 489 is also wrapped around an elevating drive pulley 482*a* mounted on the elevating drive motor 482.

Further, the pair of frames 481 are each provided with the guide rail 483 that extends in the third direction Z. As shown in FIG. 7, the guide rail 483 is substantially L-shaped when viewed from the third direction Z. Roller bearings 512 (which are to be described later) arranged on both sides of the sheet bundle holding mechanism 51 in the second direction X slide against the guide rail 483.

Note that, although the present embodiment is described based on an example in which a belt feed mechanism is used as the elevating mechanism 48, the present invention is not limited to such example. Other elevating mechanisms, such as a rack and pinion mechanism, a feed screw mechanism, a direct feed mechanism, linear motor drive mechanism surd the like, may also be used as the elevating mechanism to move up and down the sheet bundle holding mechanism 51.

[Sheet Bundle Holding Mechanism]

Next, the sheet bundle holding mechanism 51 will be described below with reference to FIGS. 3 to 12.

Figure 8:
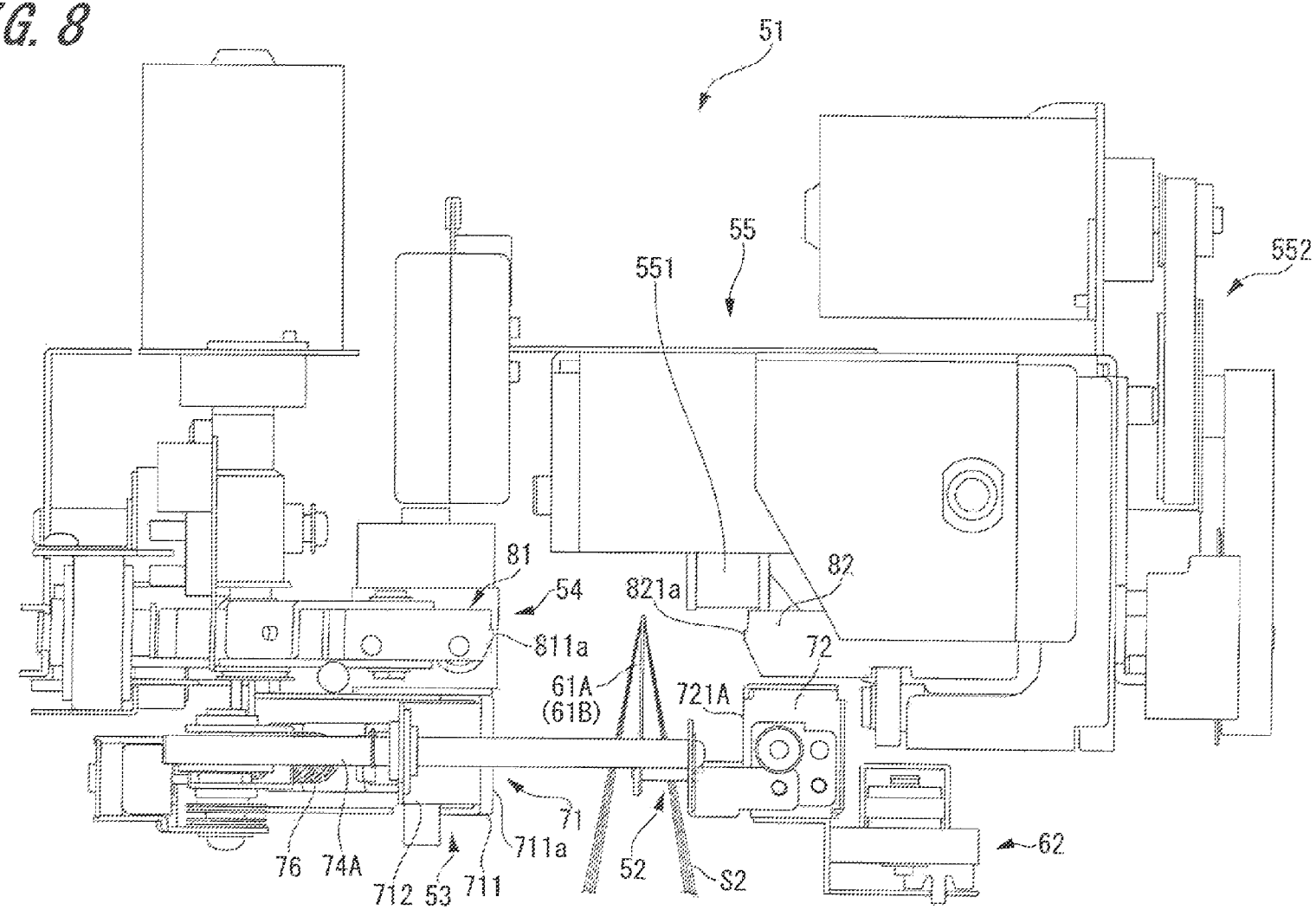
FIG. 8 is a side view showing a sheet bundle holding mechanism of the sheet processing apparatus of the present invention.

FIG. 8 is a side view of the sheet bundle holding mechanism 51.

As shown in FIG. 8, the sheet bundle holding mechanism 51 includes a sheet bundle position aligning unit 52 for aligning (adjusting) the positions of the plurality of sheets S1 of the sheet bundle S2, a first holding unit 53 and a second holding unit 54 both for holding the sheet bundle S2, and a square back processing section 55.

The first holding unit 53 and the second holding unit 54 represent a concrete example of a holding section of the present invention.

[Square Back Processing Section]

As shown in FIG. 8, the square back processing section 55 is arranged above the sheet bundle position aligning unit 52. The square back processing section 55 performs square back processing on the sheet bundle S2 held by the sheet bundle holding mechanism 51.

The square back processing section 55 includes a pressing roller 551, and a roller moving mechanism 552 for moving the pressing roller 551 along the fold of the sheet bundle S2. The square back processing section 55 transforms the folded portion of the sheet bundle S2 into a square-shaped back surface by pressing the folded portion of the sheet bundle S2 from the outside with the pressing roller 551.

[Sheet Bundle Position Aligning Unit]

The sheet bundle position aligning unit 52 includes a pair of substantially plate-like supporting plates 61A, 61B (which is a position aligning section), and a moving mechanism. 62 for moving the supporting plates 61A, 61B. The pair of supporting plates 61A, 61B represents a concrete example of a position aligning section of the present invention, and the moving mechanism 62 represents a concrete example of a moving section of the present invention.

The pair of supporting plates 61A, 61B are thin plate-like members, and are arranged between a pressing member 71 and a receiving member 72 (which are to be described later) of the first holding unit 53. One planar portion of each of the pair of supporting plates 61A, 61B faces the pressing member 71, and the other planar portion faces the receiving member 72). Further, the pair of supporting plates 61A, 61B face each other in the horizontal direction parallel to the planar portion.

The direction perpendicular to the planar portion of the supporting plates 61A, 61B is the first direction Y (thickness direction), the direction in which the pair of supporting plates 61A, 61B face each other is the second direction X, and the direction perpendicular to both the first direction Y and the second direction X is the third direction Z.

A horizontal-edge portion 61*a* substantially parallel to the second direction X and a vertical-edge portion 61*b* substantially parallel to the third direction Z are formed in the upper edge of each of the pair of supporting plates 61A, 61B, wherein the vertical-edge portion 61*b* is continuously formed from the horizontal-edge portion 61*a*. The horizontal-edge portion 61*a* of each, of the pair of supporting plates 61A, 61B abuts the fold of the sheet bundle S2 to thereby perform position alignment of the fold of the sheet bundle S2.

For example, if the horizontal-edge portion 61*a* of each of the pair of supporting plates 61A, 61B abuts a position deviated from the fold (i.e., the linear portion) of the sheet bundle S2, the sheet bundle S2 will move due to its own weight, so that the fold of the sheet bundle S2 will abut the horizontal-edge portion 61*a* of each of the pair of supporting plates 61A, 61B. Thus, if is possible to perform position alignment of the fold of the sheet bundle S2.

Incidentally, in the case where the stapling process is not performed on the sheet bundle S2, among the plurality of sheets S1 that forms the sheet bundle S2, the innermost sheet will have its fold abutting the horizontal-edge portion 61*a* of each of the supporting plates 61A, 61B. Further, the rest sheets will move due to their own weight so that the folds thereof are superimposed on each other. Thus, the pair of supporting plates 61A, 61B may also perform position alignment of the fold on the sheet bundle S2 even in the case where the stapling process is not performed on the sheet bundle S2.

On the other hand, the vertical-edge portions 61*b* of the pair of supporting plates 61A, 61B contact, the both ends of the fold of the sheet bundle S2 to thereby perform position alignment of the fold of the sheet bundle S2 in the direction along the fold of the sheet bundle S2. Incidentally, the direction along the fold of the sheet bundle S2 is substantially parallel to the second direction X.

The moving mechanism 62 includes two first moving section 63A, 63B, a second moving section 64, and a third moving section 65.

The first moving section 63A moves the supporting plate 61A in the first direction Y, and the first moving section 63B moves the supporting plate 61B in the first direction Y. The second moving section 64 moves the supporting plates 61A, 61B in the second direction X. The third moving section 65 moves the supporting plates 61A, 61B in the third direction Z.

First, the first moving sections 63A, 63B will be described below with reference to FIGS. 9 and 10.

Figure 9:
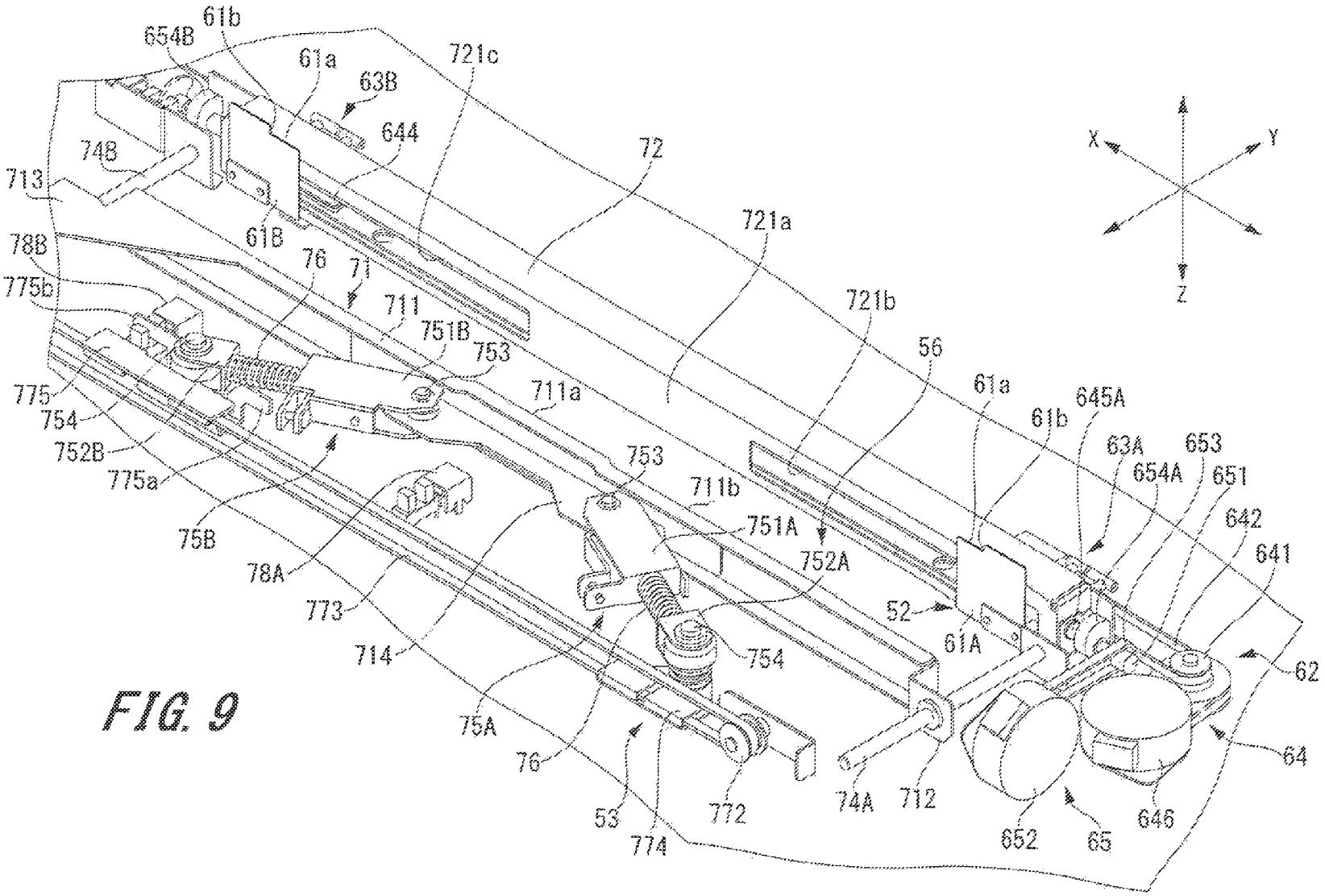
FIG. 9 is a schematic perspective view showing a sheet bundle position aligning unit and a first holding unit of the sheet bundle holding mechanism shown in FIG. 8.

FIG. 9 is a schematic perspective view showing the sheet bundle position aligning unit 52 said the first holding unit 53. FIG. 10 is a partial cross-sectional view of the sheet bundle position aligning unit 52.

Figure 10:
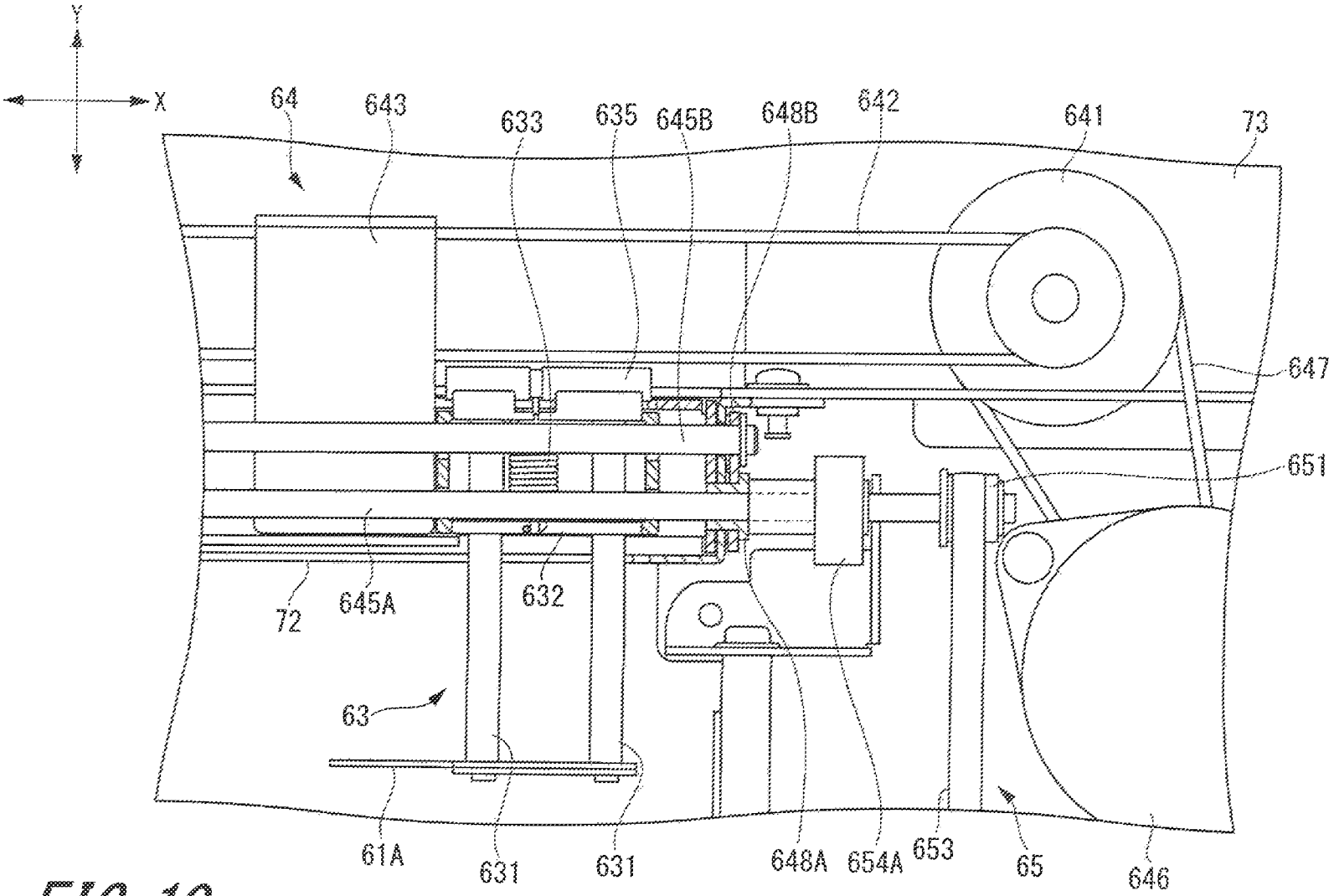
FIG. 10 is a partial cross-sectional view of the sheet bundle position aligning unit.

FIG. 10 only shows the first moving section 63A for moving the supporting plates 61A in the first direction Y, and therefore only the first moving section 63A will be described below. Incidentally, the first moving section 63B, which moves the supporting plate 61B in the first direction Y, has the same configuration as that of the first coving section 63A.

As shown in FIG. 10, the first moving section 63A has a pair of Y-shafts 631 to which the supporting plate 61A is fixed, a supporting frame 632 that movably supports the pair of Y-shafts 631 so that the pair of Y-shafts 631 can move in the first direction Y, and a biasing member 633 that biases the pair of Y-shafts 631 to one side in the first direction Y.

The pair of Y-shafts 631 are each a slim column-shaped component, and penetrate through a receiving member 72 (which is to be described later) of the sheet bundle position aligning unit 52 in the first direction Y. One tip end of each of the pair of Y-shafts 531 is located on the side of a pressing member 71 (which is to be described later) of the first holding unit 53 (see FIG. 9). The supporting plate 61A is fixed to the one tip end of each of the pair of Y-shafts 631, and a connector 635 is attached to the other tip end of each of the pair of Y-shafts 631. The connector 635 connects the pair of Y-shafts 631 so that these components are integrated.

The supporting frame 632 is a substantially quadrangular frame arranged in the receiving member 72. The supporting frame 632 has two bearing holes formed in the side piece portion thereof facing the first direction Y, and the pair of Y-shafts 631 penetrate through the two bearing holes. Further, the supporting frame 632 has two bearing holes formed in the side piece portion thereof facing the second direction X, and two X-shafts 645A, 645B (which are to be described later) penetrate through the two bearing holes.

The biasing member 633 biases the pair of Y-shafts 631 to the one side in the first direction Y. In the present embodiment, a helical extension spring is used as the biasing member 633. The biasing member 633 has one side thereof attached to the supporting frame 632 and the other side thereof attached to the connector 635. Due to the biasing force (i.e., the spring force) of the biasing member 633, the connector 635 is pulled toward one side of the first direction Y so as to abut the supporting frame 632.

The position of the supporting plate 61A (61B) in the first direction Y when the connector 635 abuts the supporting frame 632 is defined as a "reception position". A predetermined gap is formed between the supporting plate 61A (61B) arranged in the reception position and the receiving member 72. Half of the center-folded sheet bundle S2 is inserted into the gap.

When being pressed by the pressing member 71 (see FIG. 7), the supporting plate 61A will move toward the other side of the first direction Y against the biasing force of the biasing member 633, so as to be brought close to the receiving member 72. When the pressing member 71 moves away from the supporting plate 61A, the supporting plate 61A will move toward the one side of the first direction Y due to the biasing force of the biasing member 633, so as to return to the reception reference position.

In the present embodiment, a helical extension spring is used as the biasing member 633. However, instead of the helical extension spring, other spring member such as a helical compression, a leaf spring or the like, or a rubber member may also be used as the biasing member of the present invention, as long as such spring member or rubber member can bias the pair of Y-shafts 631 to one side (i.e., the side of the pressing member 71) in the first direction Y.

Next, the second moving section 64 will be described below with reference to FIGS. 9 and 10.

The second moving section 64 is adapted to move the supporting plates 61A, 61B and the first moving sections 63A, 61B in the second direction X. As shown in FIG. 10, the second moving section 64 has a drive pulley 641, a drive belt 642, two sliders 643, 644 (see FIG. 9), and two X-shafts 645A, 645B. The second moving section 64 further has a second moving section drive source 646 for rotates the drive pulley 641, and a driven pulley (not shown).

The drive pulley 641 and the driven pulley are rotatably attached to a supporting member 73 (which is to be described later) of the first holding unit 51. The drive pulley 641 and the driven pulley sire arranged in the second direction X apart from each other by a suitable distance. The rotary axis of the drive pulley 641 and the rotary axis of the driven pulley are both parallel to the third direction Z.

The drive belt 642 is an endless belt wrapped around the drive pulley 641 and the driven pulley. The drive belt 642 has two linear portions extending in the second direction X and facing each other in the first direction Y.

The slider 643 is fixed to one of the linear portions of the drive belt 642 on the other side in the first direction Y, and the slider 644 is fixed to the other of the linear portions of the drive belt 642 on the one side in the first direction Y (not shown in the drawings). Thus, when the drive belt 642 rotates between the drive pulley 641 and the driven pulley, the sliders 643, 644 will move in directions opposite to each other in the second direction X.

The supporting frame 632 of the first moving section 63A is fixed to the slider 643, and the supporting frame 632 of the first moving section 63B is fixed to the slider 644.

The X-shafts 645A, 645B guide the supporting frames 632 of the first moving sections 63A, 63B in the second direction X. The X-shafts 645A, 645B are each a slim column-shaped component supported by the receiving member 75. The X-shafts 645A, 645B penetrate through the bearing holes formed in the supporting frames 632 of the first moving section 63A, 63B.

The bearing holes formed in the supporting frames 632 of the first moving section 63A, 63B are each formed in circular shape whose diameter is substantially equal to that of the X-shafts 645A, 645B. Thus, the first moving section 63A, 63B can move in the second, direction X along the X-shafts 645A, 645B.

The X-shafts 645A, 645B penetrate through the bearing holes formed in the receiving member 72. The bearing holes formed in the receiving member 72 each have a substantially rectangular shape whose long side extends in the third direction Z. The length of the short, side of each of the bearing holes is substantially equal to the diameter of each of the X-shafts 645A, 645B, and the length of the long side of each of the bearing holes is larger than the diameter of each of the X-shafts 645A, 645B. Thus, the X-shafts 645A, 645B can move in the third direction Z.

Further, a locking ring 648A is attached to the X-shaft 645A. The locking ring 648A is adapted to lock the X-shaft 645A so that it does not move in the second direction X. Further, a locking ring 648B is attached to the X-shaft 645B. The locking ring 648B is adapted to lock the X-shaft 645B so that it does not move in the second direction X.

The second moving section drive source 646 is attached to the supporting member 73.

In the present embodiment, a stepping motor is used as the second moving section drive source 646. Further, a transmission belt 647 is provided between the second moving section drive source 646 and the drive pulley 641. The transmission belt 647 is adapted to transmit rotating force of the second moving section drive source 646 to the drive pulley 641.

When the second moving section drive source 646 is driven, the drive pulley 641 will rotate, so that the drive belt 642 will rotate between the drive pulley 641 and the driven pulley. Thus, the supporting plate 61A attached to the slider 643 through the first moving section 63A and the supporting plate 61B (see FIG. 9) attached to the slider 644 through the first moving section 63B will move in directions opposite to each other in the second direction X direction. The distance between the pair of supporting plates 61A, 61B in the second direction X is changed according to the length of the fold of the sheet bundle S2.

Next, the third moving section 65 will be described below with reference to FIGS. 9, 11A and 11B.

FIGS. 11 A and 11B are side views showing the third moving section 65.

The third moving section 65 moves the X-shaft 645A in the third direction Z to thereby move the pair of supporting plates 61A, 61B in the third direction Z. As shown in FIGS. 11A and 11B, the third moving section 65 has a drive pulley 651, a third moving section drive source 652, a transmission belt 653, two eccentric cams 654A, 654B, and two engaging bases 655A, 655B.

The drive pulley 651 is attached to one end of the X-shaft 645A (see FIG. 9). The center of the drive pulley 654 is coincident with the center of the X-shaft 645A in the second direction X.

The third moving section drive source 652 is attached to a drive source mounting portion 732 (which is to be described later) of the supporting member 73 (see FIG. 2). In the present embodiment, a stepping motor is used as the third moving section drive source 652. The transmission belt 653 transmits the rotating force of the third moving section drive source 652 to the drive pulley 651.

The eccentric cams 654A, 654B each have a substantially circular shape, and are attached to both ends of the X-shaft 645A protruding from the receiving member 72 (see FIG. 9). The eccentric cam 654A is arranged between the receiving member 72 and the drive pulley 651. As shown in FIGS. 11A and 11B, the X-shaft 645A penetrates through a position deviated from the center of the eccentric cams 654A, 654B.

The engaging bases 655A, 655B are each a column-shaped component whose axial center is parallel to the second direction X. The engaging bases 655A, 655B respectively face the eccentric cams 654A, 654B. The engaging bases 655A, 655B are attached to the supporting member 73 (see FIG. 12) so that their can rotate with the axial centers thereof as the rotation center.

The engaging bases 655A, 655B support the eccentric cams 654A, 654B while maintaining line contact with the eccentric cams 654A, 654B.

Figure 11B:
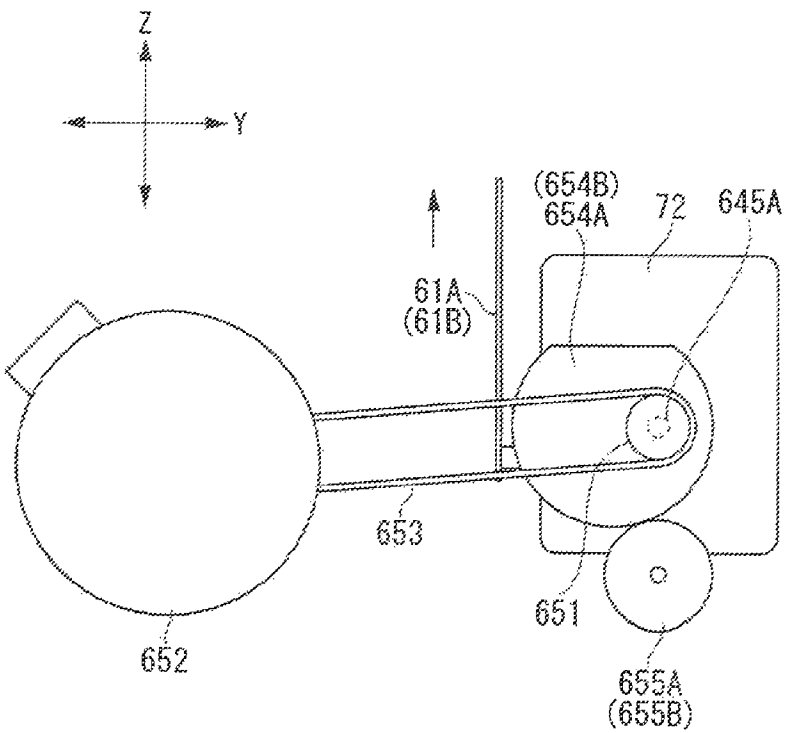
FIGS. 11 A and 11B are side views showing a third moving section of the sheet bundle position aligning unit.
Figure 11A:
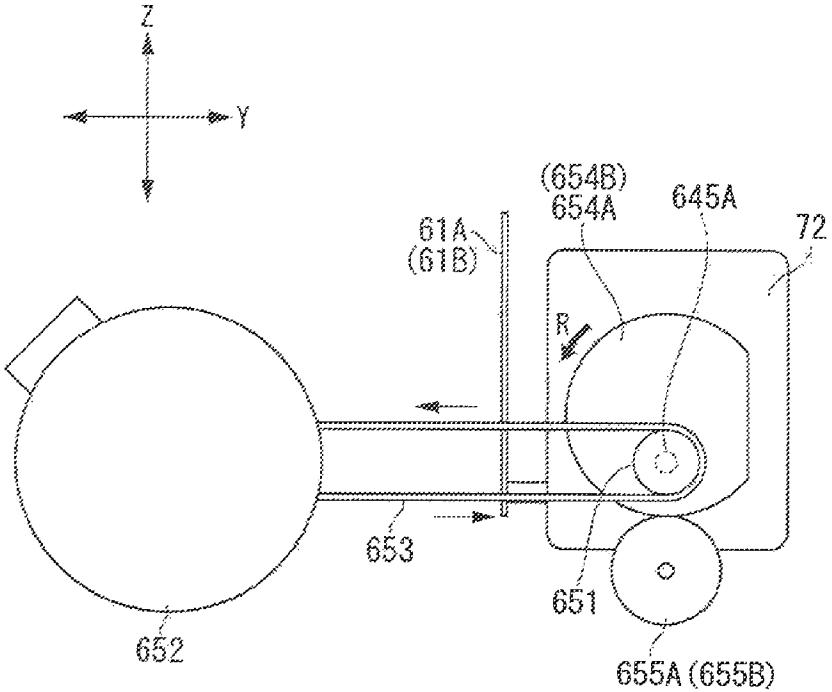

When the third moving section drive source 652 is driven from the state shown in FIG. 11A, the rotating force of the third moving section drive source 652 will be transmitted to the drive pulley 651 by the transmission belt 653, so that the drive pulley 651 rotates in, for example, direction R. Thus, the X-shaft 645A rotates in the direction R, and the eccentric cams 654A, 654B attached to the X-shaft 645A also rotate in the direction R.

The eccentric cams 654A, 6543 rotate in the direction R while maintaining line contact with the engaging bases 655A, 655B. Since the center of the eccentric cams 654A, 654B is deviated from the X-shaft 645A, the relative distance between the X-shaft 645A and the engaging bases 655A, 655B changes. Thus, as shown in FIG. 11B, the X-shaft 645A is displaced toward one side (i.e., the upper side) in the third direction Z while the X-shaft 645A rotates with the axial center thereof as the rotation center. At this time, the transmission belt 653 elastically deforms so as to follow the displacement of the drive pulley 651 in the third direction Z.

The X-shaft 645A is integrated with the X-shaft 645B and the supporting plates 61A, 61B by the first moving sections 63A, 63B (see FIG. 10). Thus, when the X-shaft 645A is displaced toward the one side (i.e., the upper side) in the third direction Z, the X-shaft 645B and the supporting plates 61A, 61B will move toward the one side (i.e., the upper side) in the third direction Z.

Further, in the case where the supporting plates 61A, 61B is moved toward the other side (i.e., the lower side) in the third direction Z from the state shown in FIG. 11B, the third moving section drive source 652 will drive the drive pulley 651 to rotate in a direction opposite to the direction R. Thus, the eccentric cams 654A, 654B will rotate in the direction opposite to the direction R while maintaining line contact with the engaging bases 655A, 655B.

As a result, the relative distance between the X-shaft 645A and the engaging bases 655A, 655B changes, and the X-shaft 645A is displaced toward the other side (i.e., the lower side) in the third direction Z. Further, the supporting plates 61A, 61B are moved toward the other side (i.e., the lower side) in the third direction Z along with the X-shaft 645A.

In the present embodiment, the substantially plate-like supporting plates 61A, 61B are used as the position aligning section; however, instead of the plate-like member, other component such as a pin with small diameter or the like may also be used as the position aligning section or the present invention. Incidentally, it is preferred that the position aligning section has a shape that is thinner than the fold formed in the sheet S1, and that extends along the fold.

[First Holding Unit]

First, the first holding unit 53 will be described below with reference to FIGS. 9 and 12.

Figure 12:
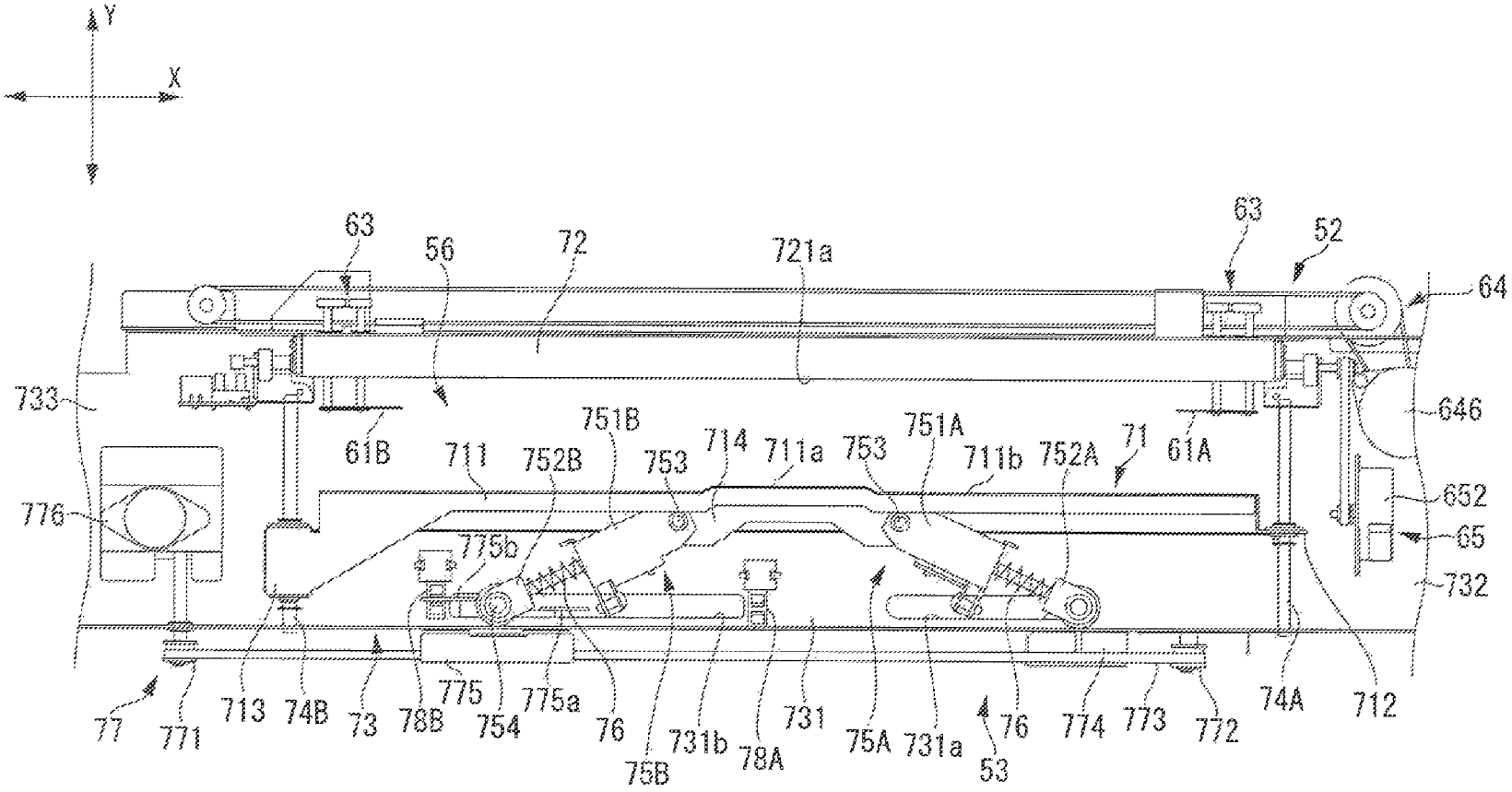
FIG. 12 is a plan view showing a holding unit of the sheet bundle holding mechanism shown in FIG. 8.

FIG. 12 is a plan view of the first holding unit 53.

The first holding unit 53 is adapted to hold the sheet bundle S2 whose position has been aligned by the sheet bundle position aligning unit 52, so that the plurality of sheets S1 of the sheet bundle S2 sure not out of alignment.

As shown in FIGS. 9 and 12, the first holding unit 53 includes the pressing member 71, the receiving member 72, the supporting member 73, two guide shafts 74A, 74B, two pivot arms 75A, 75B, two resilient members 76 and a drive mechanism 77. Incidentally, the supporting member 73 is not shown in FIG. 9.

The pressing member 71 includes a pressing portion 711, two bearing portions 712, 713, and an arm connector 714. The pressing portion 711 is a substantially rectangular component extending in the second direction X (i.e., the horizontal direction), and includes a pressing surface 711*a* that faces the receiving member 72 with the sheet bundle S2 interposed in between.

The pressing surface 711*a* is arranged in the center portion of the pressing portion 711 in the second direction X. The both sides of the pressing surface 711*a* in the second direction X are each provided with a recessed surface 711*b* that recesses from the pressing surface 711*a* toward the one side in the first direction Y. The recessed surfaces 711*b* each form an evacuation space between itself and the receiving member 72. The supporting plates 61A, 61B of the sheet bundle position aligning unit 52 are evacuated to the evacuation spaces. In the evacuation spaces, the supporting plates 61A, 61B can move in the second direction X.

The bearing portions 712, 713 are arranged in both end portions of the pressing portion 711 in the second direction X. The bearing portion 712 is slidably engaged with the guide shaft 74A, and the bearing portion 713 is slidably engaged with the guide shaft 74B.

The arm connector 714 is arranged in the pressing portion 711 on the side opposite to the pressing surface 711*a*. Tip ends 751A, 751B (which are to be described later) of the pivot arms 75A, 75B are rotatably connected to the arm connector 714.

The receiving member 72 is a quadratic prism shaped hollow member extending in the second direction X. The receiving member 72 is fixed to the supporting member 73.

The receiving member 72 has a receiving surface 721*a* that faces the pressing surface 711*a*. As shown in FIG. 9, openings 721*b*, 721*c* are arranged on both sides of the receiving surface 721*a* in the second direction X. The openings 721*b*, 721*c* are provided for penetrating the Y-shafts 631 (see FIG. 10) of the first moving sections 63A, 63B of the sheet bundle position aligning unit 52 therethrough.

As shown in FIG. 12, the supporting member 73 is substantially U-shaped in plan view. The supporting member 73 has a substantially rectangular arm guiding portion 731 extending in the second direction X, and two drive source mounting portions 732, 733 respectively formed continuously from the both ends of the arm guiding portion 731 in the second direction X.

The arm guiding portion 731 is provided with two guide grooves 731*a*, 731*b* for guiding two base ends 752A, 752B (which are to be described later) of the pivot arms 75A, 75B in the second direction X. Two slider detecting sensors 78A, 78B for detecting the pivoting state of the pivot arm 75B are arranged on both side of the guide groove 731*b* in the second direction X.

One end portion of the receiving member 72 in the longitudinal direction is fixed to the drive source mounting portion 732, and the other end portion of the receiving member 72 in the longitudinal direction is fixed to the drive source mounting portion 733. Thus, the supporting member 73 and the receiving member 72 form a frame which has an opening 56 for receiving the sheet bundle S2. The supporting plates 61A, 61B of the sheet bundle position aligning unit 52 are arranged in the opening 56.

Further, the second moving section drive source 646, the third moving section drive source 652 and the like of the sheet bundle position aligning unit 52 are mounted on the drive source mounting portion 732, and a first holding unit drive source 776 (which is to be described later) of the drive mechanism 77 is mounted on the drive source mounting portion 733.

Further, the drive source mounting portion 732 supports the guide shaft 74A, and the drive source mounting portion 733 supports the guide shaft 74B.

The axial direction of the guide shaft 74A, 74B is parallel to the first direction Y. The bearing portion 712 is slidably engaged with the guide shaft 74A, and the bearing portion 713 is slidably engaged with the guide shaft 74B. Thus, the pressing member 71 moves in the first direction Y along the guide shafts 74A, 74B.

The pivot arm 75A has a tip end 751A and a base end 752A to which the tip end 751A is slidably connected, and can expand and contract in the axial direction in which the tip end 751A and the base end 752A are connected.

The pivot arm 75B has the same configuration as that of the pivot arm 75A, and includes a tip end 751B and a base end 752B. The shape of one tip end 751A and the shape of the tip end 751B are symmetrical to each other in the present embodiment, however the tip end 751A and the tip end 751B may also have the same shape.

The tip ends 751A, 751B are rotatably connected to the arm connector 714 of the pressing member 71 by rotating shafts 753. The axial direction of the rotating shafts 753 extends in the third direction Z. Thus, the pivot arms 75A, 75B each pivot in the horizontal direction which includes the first direction Y and the second direction X.

Further, the rotating shafts 753 are arranged on the outer side in the second direction X than the pressing surface 711*a* of the pressing member 71. Further, connection points where the tip ends 751A, 751B are connected to the arm connector 714 save set on the outer side in the second direction X than the pressing surface 711*a*.

The base end 752A of the pivot arm 75A is rotatably connected to a slider 774 (which, is to be described later) of the drive mechanism 77 by a rotating shaft 754. The axial direction of the rotating shafts 754 extends in the third direction Z. Further, the base end 752A is slidably engaged with the guide groove 731*a* of the supporting member 73. Thus, the pivot arm 75A moves in the second direction X along the guide groove 731*a* while pivoting with respect to the slider 774.

The base end 752B of the pivot arm 75B is rotatably connected to a slider 775 (which is to be described later) of the drive mechanism 77 by another rotating shaft 754. Further, the base end 752B is slidably engaged with the guide groove 731*b* of the supporting member 73. Thus, the pivot arm 75B moves in the second direction X along the guide groove 731*b* while pivoting with respect to the slider 775.

One of the two resilient members 76 is interposed between the tip end 751A and the base end 752A of the pivot arm 75A, and the other of the two resilient members 76 is interposed between the tip end 751B and the base end 752B of the pivot arm 75B. The resilient members 76 generate resisting force when the pivot arms 75A, 75B contract.

In the present embodiment, helical compression springs are used as the resilient members 76. However, instead of the helical compression springs, other spring members such as a leaf springs or the like may also be used as the resilient members of the present invention, as long as such spring members generate resisting force when the pivot arms contract.

In a state where the sheet bundle S2 is not interposed between the pressing member 71 and the receiving member 72, the pressing surface 711*a* will abut the receiving surface 721*a* when the axial direction of the pivot arms 75A, 75B becomes perpendicular to the pressing surface 711*a*. At this time, the pivot arms 75A, 75B contract in the axial direction, and the resilient members 76 (i.e., the helical compression springs) are compressed. Thus, the sheet bundle S2 can be reliably pressed and held by the pressing member 71 and the receiving member 72 even if the thickness of the sheet bundle S2 is small.

The drive mechanism 77 moves the base ends 752A, 752B of the pivot arms 75A, 75B in the second direction X. The drive mechanism 77 includes a driving pulley 771, a driven pulley 772, a conveying belt 773, two sliders 774, 773, and a first holding unit drive source 776 for rotating the driving pulley 771.

The driving pulley 771 is rotatably mounted on the drive source mounting portion 733 of the supporting member 73, and the driven pulley 772 is rotatably mounted on the drive source mounting portion 732 of the supporting member 73. The rotary axis of the drive pulley 771 and the rotary axis of the driven pulley 772 are both parallel to the first direction Y.

The conveying belt 773 is an endless belt wrapped around the drive pulley 771 and the driven pulley 772. The conveying belt 773 has two linear portions extending in the second direction X and facing each other in the third direction Z.

The sliders 774, 775 are fixed to the linear portions of the conveying belt 773. As shown in FIG. 3, the slider 774 is fixed to one of the linear portions of the conveying belt 773 on the one side (i.e., the upper side) in the third direction Z, and the slider 775 is fixed to the other of the linear portions of the conveying belt 773 on the other side (i.e., the lower side) in the third direction Z. Thus, when the conveying belt 773 rotates between the driving pulley 771 and the driven pulley 772, the sliders 774, 773 will move in directions opposite to each other in the second direction X.

The base end 752A of the pivot arm 75A is rotatably mounted on the slider 774 by the rotating shaft 754. The base end 752B of the pivot arm 75B is rotatably mounted on the slider 775 by the rotating shaft 754. Further, two detection protrusions 775*a*, 775*b* are arranged in the slider 775.

When the slider 775 moves toward the one side in the second direction X, the slider detecting sensor 78A will detect the defection protrusion 775*a*; and when the slider 775 moves toward the other side in the second direction X, the slider detecting sensor 783 will detect the detection protrusion 775*b*. The angle of the axial direction of the pivot arm 75B with respect to the pressing surface 711*a* changes according to the position of the slider 775. Thus, the rotation state of the pivot arm 75B can be detected by detecting the position of the slider 775 by using the slider defecting sensors 78A, 78B.

An AC motor, a DC motor or the like, for example, can be used as the first holding unit drive source 776. Further, a transmission mechanism (not shown) is provided between the first holding unit drive source 776 and the driving pulley 771. The transmission mechanism is adapted to transmit rotating force or the first holding unit drive source 776 to the drive pulley 771.

When the position of the sheet bundle S2 has been adjusted by the pair of supporting plates 61A, 61B of the sheet bundle position aligning unit 52, the first holding unit 53 will press the sheet bundle S2 so as to hold the sheet bundle S2. To hold the sheet bundle S2, the first holding unit drive source 776 of the drive mechanism 77 is driven so as to move the slider 774 toward the other side in the second direction X and move the slider 775 toward the one side in the second direction X.

Thus, the base end 752A of the pivot arm 75A moves toward the other side in the second direction X along the guide groove 731*a* while rotating relative to the slider 774 with the rotating shaft 754 as the rotation center. Further, the tip end 751A of the pivot arm 75A rotates with the rotating shaft 753 as the rotation center.

Further, the base end 752B of the pivot arm 75B moves toward the one side in the second direction X along the guide groove 731*b* while rotating relative to the slider 775 with the rotating shaft 754 as the rotation center. Further, the tip end 751B of the pivot arm 75B rotates with the rotating shaft 753 as the rotation center.

As a result, since the pivot arms 75A, 75B pivot so as to rise in the first direction Y, the pressing member 71 moves in the first direction Y along the guide starts 74A, 74B so as to approach the receiving member 72. Thus, the pressing surface 711*a* of the pressing member 71 presses the sheet bundle S2 toward the side of the receiving surface 721*a* of the receiving member 72, so that the sheet bundle S2 is sandwiched and held by the pressing surface 711*a* and the receiving surface 721*a*.

At this time, the pair of supporting plates 61A, 61B of the sheet bundle position aligning unit 52 move in the first direction Y along with the sheet bundle S2 so as to be brought into the evacuation space formed between the pressing member 71 and the receiving member 72.

When the first holding unit 53 holds the sheet bundle S2, the axial direction of the pivot arms 75A, 75B will become perpendicular to the pressing surface 711*a* of the pressing member 71 (i.e., the angle between the axial direction of the pivot arms 75A, 75B and the pressing surface 711*a* becomes 90 degrees), and therefore the pivot arms 75A, 75B contract in the axial direction. Due to the resilient force of the compressed resilient member 76, the pressing member 71 is biased to the side of the receiving member 72. Thus, even if the driving of the first holding unit drive source 776 is stopped, the pressing force of the pressing member 71 can be maintained, and therefore it is possible to hold the sheet bundle S2 so that the plurality of sheets S1 are not out of alignment.

Note that the holding unit of the present invention is not limited to the aforesaid configuration, but may also have other configurations as long as the axial direction of the pivot arms becomes substantially perpendicular to the pressing surface and the pressing member is biased to the side of the receiving member of the pressing member by the resilient force of the resilient member. If is preferred that the angle of the axial direction of the pivot arms with respect to the pressing surface is in a range of, for example, 85 to 95 degrees.

[Second Holding Unit]

First, the second holding unit 54 will be described below with reference to FIGS. 13 and 14.

Figure 13:
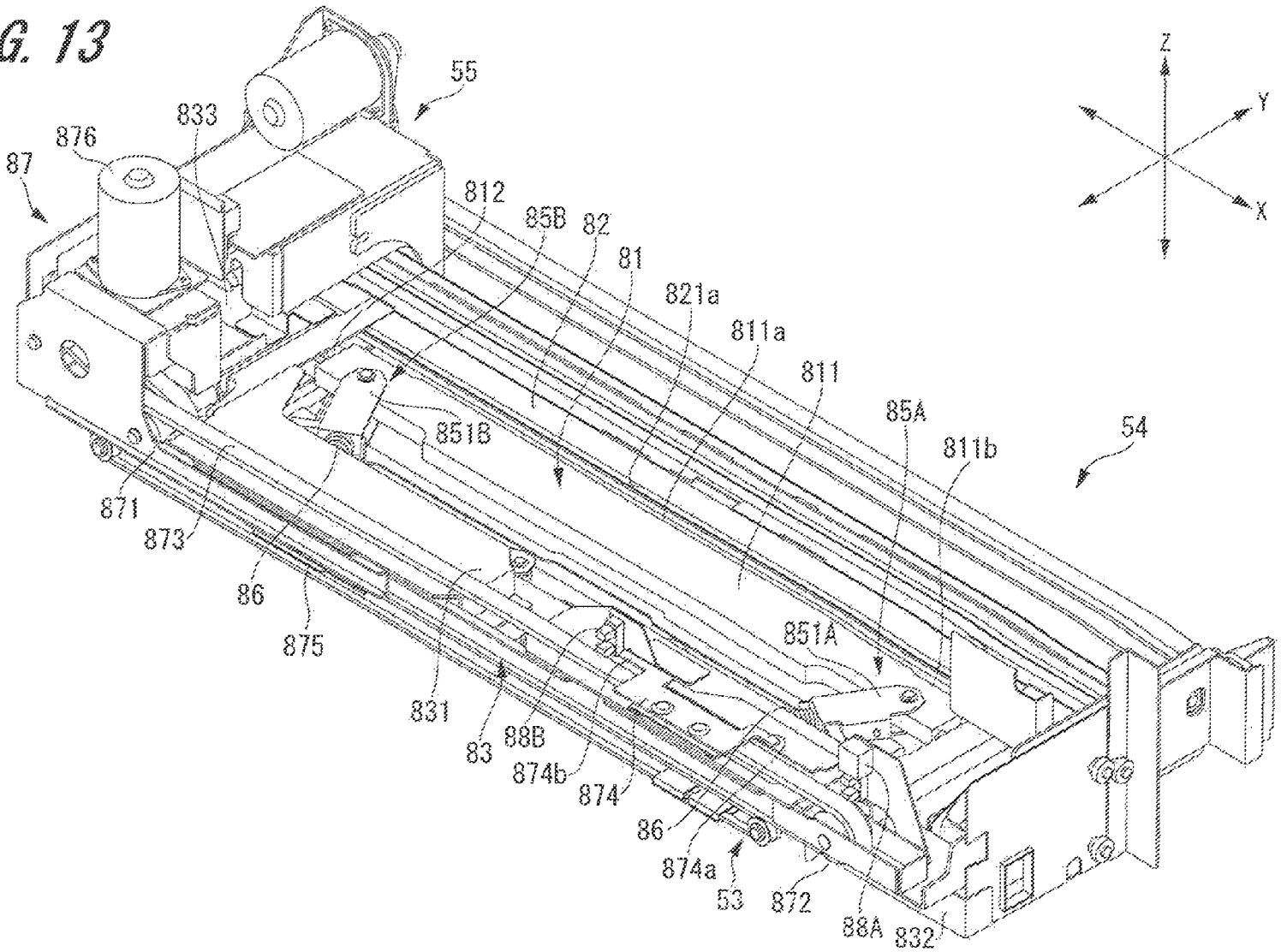
FIG. 13 is a schematic perspective view showing a second holding unit of the sheet bundle holding mechanism shown in FIG. 8.
Figure 14:
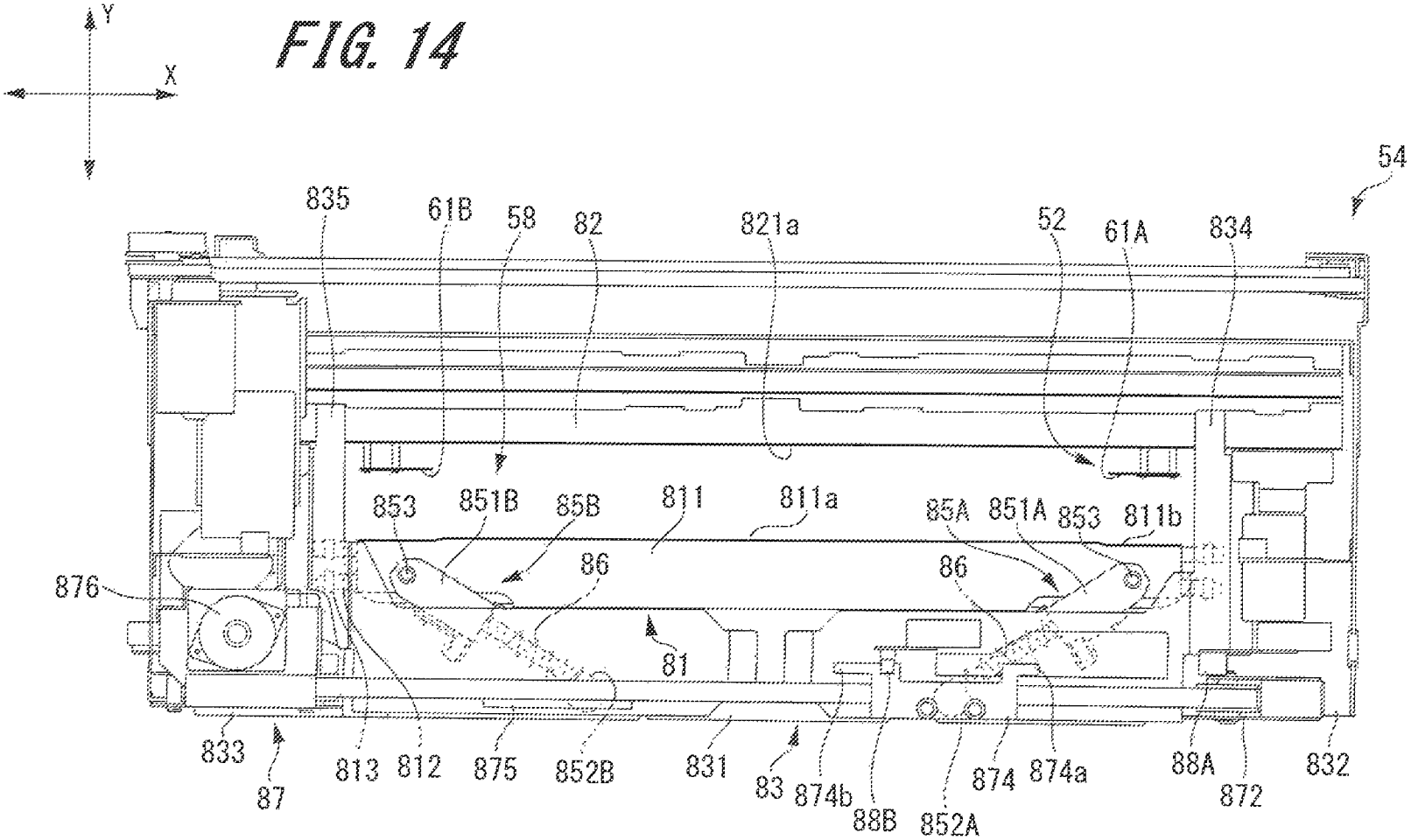
FIG. 14 is a plan view showing the second holding unit of the sheet bundle holding mechanism shown in FIG. 8.

FIG. 13 is a schematic perspective of the second holding unit 54, and FIG. 14 is a plan view of the second holding unit 54.

As shown in FIG. 13, the second holding unit 54 is arranged on the one side (i.e., the upper side) of the first holding unit 53 in the third direction Z. The second holding unit 54 is used to perform square back processing on the folded portion of the sheet bundle S2 whose position has been aligned by the sheet bundle position aligning unit 52. To be specific, the second holding unit 54 holds the vicinity of the folded portion of the sheet bundle S2 over the whole length of the fold, so that the plurality of sheets S1 are not out of alignment.

As shown in FIGS. 13 and 14, the second holding unit 54 has the same configuration as that of the first holding unit 53, and includes a pressing member 81, a receiving member 82, a supporting member 83, two pivot arms 85A, 85B, two resilient members 86, and a drive mechanism 87.

The pressing member 81 includes a pressing portion 811, a plurality of axles 812, and a plurality of axle wheels 813 (see FIG. 14). The pressing portion 811 is a substantially rectangular column-shaped component extending in the second direction X, and includes a pressing surface 811*a* that faces the receiving member 82 with the sheet bundle S2 interposed in between.

The length of the pressing surface 811*a* in the second direction X is set to be equal to or larger than the length of the fold of the center-folded sheet bundle S2. Further, in the present embodiment, since plural kinds of sheet bundles with different fold, lengths are to be held by the second holding unit 54, the length of the pressing surface 811*a* in the second direction X is determined according to the size of the sheet bundle having largest fold length.

Further, the length of the pressing surface 811*a* of the second holding unit 54 in the third direction Z is smaller than the length of the pressing surface 711*a* (see FIG. 9) of the first holding unit 53 in the third direction Z. Thus, the area of the pressing surface 811*a* is smaller, and therefore the pressing force per unit area (for example, 1 per square centimeter) can be increased. As a result, the pressing force necessary for performing square back processing can be ensured even if the resilient force of the resilient member 86 is reduced.

Further, the pressing member 81 of the second holding unit 54 does not become an obstacle when the sheet bundle S2 is to be transferred from the sheet bundle holding mechanism 51 to other processing section (for example, the ejecting section 39).

The both sides of the pressing surface 611*a* in the second direction X are each provided with a recessed surface 811*b* that recesses from the pressing surface 811*a*. The recessed surfaces 811*b* each form an evacuation space between itself and the receiving member 32. The supporting plates 61A, 61B (see FIG. 14) of the sheet bundle position aligning unit 52 are evacuated to the evacuation spaces.

Both ends of the pressing portion 811 in the second direction X each have two axles 812 connected thereto, each axle 812 protruding in the second direction X. Each axle 812 has a wheel 813 rotatably attached thereto. When the pressing member 81 moves in the first direction Y, the wheels 813 will rotate with the axles 812 as the rotation center, so that the wheels 813 will roll against the guiding portions 834, 835 (which are to be described later) of the supporting member 83 (see FIG. 14).

The receiving member 82 is a substantially rectangular column-shaped component extending in the second direction X. The receiving member 82 is fixed to the supporting member 83. In other words, the receiving member 82 and the supporting member 83 are integrated with each other. The receiving member 82 has a receiving surface 821*a* that faces the pressing surface 811*a*.

As shown in FIG. 14, the supporting member 83 is substantially U-shaped in plan view. The supporting member 83 has a substantially rectangular arm guiding portion 831 extending in the second direction X, and two side portions 832, 833 respectively formed continuously from the both ends of the arm guiding portion 731 in the second direction X.

The arm guiding portion 831 is provided with two guide grooves (not shown) for guiding two base ends 852A, 852B (which are to be described later) of the pivot arms 85A, 85B in the second direction X.

The side portions 832, 833 respectively face the drive source mounting portions 732, 733 (see FIG. 12) of the first holding unit 53 in the third direction Z.

One end portion on of the receiving member 82 in the second direction X is fixed to the side portion 832, and the other end portion of the receiving member 82 in the second direction X is fixed to the side portion 833. Thus, the supporting member 83 and the receiving member 82 form a frame which has an opening 58 for receiving the sheet bundle S2. Further, the opening 58 of the second holding unit 54 faces the opening 56 of the first holding unit 53 in the third direction Z.

Further, the side portions 832, 833 are respectively provided with guiding portions 834, 835 for guiding the wheels 813 of the pressing member 81. The guiding portions 834, 835 each have a substantially U-shaped longitudinal section (the section parallel to the third direction Z), and are adapted to regulate the movement of the wheels 813 in both the second direction X and the third direction Z. Thus, the pressing member 81 is guided by the guiding portions 834, 835 so as to move in the first direction Y.

Sensors 88A, 88B are respectively mounted on the side portion 832 and the arm guiding portion 831. The sensors 88A, 88B are adapted to detect the pivoting state of the pivot arm 85A. Further, a second holding unit drive source 876 of the drive mechanism 87 is mounted on the side portion 833.

The pivot arm 85A has a tip end 851A and a base end 852A to which the tip end 851A is slidably connected, and can expand and contract in the axial direction in which the tip end 851A and the base end 852A are connected.

The pivot arm 85B has the same configuration as that of the pivot arm 85A, and includes a tip end 8513 and a base end 852B. The shape of the tip end 851A and the shape of the tip end 851B are symmetrical to each other in the present embodiment, however the tip end 851A and the tip end 851B may also have the same shape.

The tip ends 851A, 851B are each rotatably connected to the pressing portion 811 of the pressing member 81 by a rotating shaft 853. Thus, the pivot arms 85A, 85B each pivot in the horizontal direction which includes the first direction Y and the second direction X.

The base end 852A of the pivot arm 85A is rotatably connected to a slider 874 (which is to be described, later) of the drive mechanism 87 by a rotating shaft (not shown). Further, the base end 852A is slidably engaged with the guide groove (not shown) of the supporting member 83. Thus, the base end 852A of the pivot arm 85A moves in the second direction X along the guide groove while pivoting with respect to the slider 874.

The base end 852B of the pivot arm 85B is rotatably connected to a slider 875 (which is to be described later) of the drive mechanism 87 (see FIG. 13) by a rotating shaft (not shown). Further, the base end 852B is slidably engaged with the guide groove (not shown) of the supporting member 83. Thus, the base end 852B of the pivot arm 853 moves in the second direction X along the guide groove while pivoting with respect to the slider 875.

One of the two resilient members 86 is interposed between the tip end 851A and the base end 852A of the pivot arm 85A, and the other of the two resilient members 86 is interposed between the tip end 851B and the base end 852B of the pivot arm 85B. The resilient members 86 generate resisting force when the pivot arms 85A, 85B contract.

In a state where the sheet bundle S2 is not interposed between the pressing member 81 and the receiving member 82, the pressing surface 811*a* will abut the receiving surface 821*a* when the axial direction of the pivot arms 85A, 85B becomes perpendicular to the pressing surface 811*a*. At this time, the pivot arms 85A, 85*b* contract in the axial direction thereof, and the resilient members 86 (i.e., the helical compression springs) are compressed. Thus, the sheet bundle S2 can be reliably pressed and held by the pressing member 81 and the receiving member 82 even if the thickness of the sheet bundle S2 is small.

The drive mechanism 87 moves the base ends 852A, 852B of the pivot arms 85A, 85B in the second direction X. The drive mechanism 87 includes a driving pulley 871 (see FIG. 13), a driven pulley 872, a conveying belt 873, two sliders 874, 875, and the second holding unit drive source 876 for rotating the driving pulley 876.

The driving pulley 871 is rotatably mounted on the side portion 833 of the supporting member 83, and the driven pulley 872 is rotatably mounted on the side portion 832 of the supporting member 83.

The conveying belt 873 is wrapped around the driving pulley 671 and the driven pulley 872. The conveying belt 873 has two linear portions extending in the second direction X and facing each other in the third direction Z.

As shown in FIG. 13, the slider 875 is fixed to one of the linear portions of the conveying belt 873 on the one side (i.e., the upper side) in the third direction Z, and the slider 874 is fixed to the other of the linear portions of the conveying belt 873 on the other side (i.e., the lower side) in the third direction Z. Thus, when the conveying belt 871 rotates between the driving pulley 872 and the driven pulley 873, the sliders 874, 875 will move in directions opposite to each other in the second direction X.

The base end 852A of the pivot arm 85A is rotatably mounted on the slider 874 by the rotating shaft (not shown). The base end 852B of the pivot arm 85B is rotatably mounted on the slider 875 by the rotating shaft (not shown). Further, two detection protrusions 874*a*, 874*b* are arranged in the slider 874.

When the slider 374 moves toward the one side in the second direction X, the sensor 88A will detect, the detection protrusion 874*a*; and when the slider 874 moves toward the other side in the second direction X, the sensor 88B will detect the detection protrusion 874*b*. Since the angle of the axial direction of the pivot arm 85B with respect to the pressing surface 811*a* changes according to the position of the slider 874, the rotation state of the pivot arm 85A can be detected by detecting the position of the slider 874 by using the sensors 88A, 88B.

An AC motor, a DC motor or the like, for example, may be used as the second holding unit drive source 876. Further, a transmission mechanism (not shown) is provided between the second holding unit drive source 876 and the driving pulley 871. The transmission mechanism is adapted to transmit rotating force of the second holding an it drive source 876 to the drive pulley 871.

After the sheet bundle 82 has been held by the first holding unit 53, the second holding unit 54 holes the vicinity of the folded portion of the sheet bundle S2 along the fold. Since the operation of the second holding unit 54 is identical to that of the first holding unit 53 when holding the sheet bundle S2, the description of the operation of the second holding unit 54 will be omitted.

Incidentally, although the present embodiment is described based on a configuration in which the pivot arms 75A, 75B, 85A, 85B are used to move the pressing members 71, 81, the present invention is not limited to such a configuration. For example, various other configurations such as an air cylinder, a cam mechanism or the like may also be used as the configuration for mowing the pressing members 71, 81. Further, in addition to the configuration for moving only the pressing members 71, 81, the present invention may include a configuration for moving both the pressing members 71, 81 and the receiving members 72, 82 in the first direction Y.

[Sheet Processing Control Circuit]

Next, the configuration of the sheet processing control circuit 90 of the sheet processing apparatus 3 will be described below with reference to FIG. 15.

Figure 15:
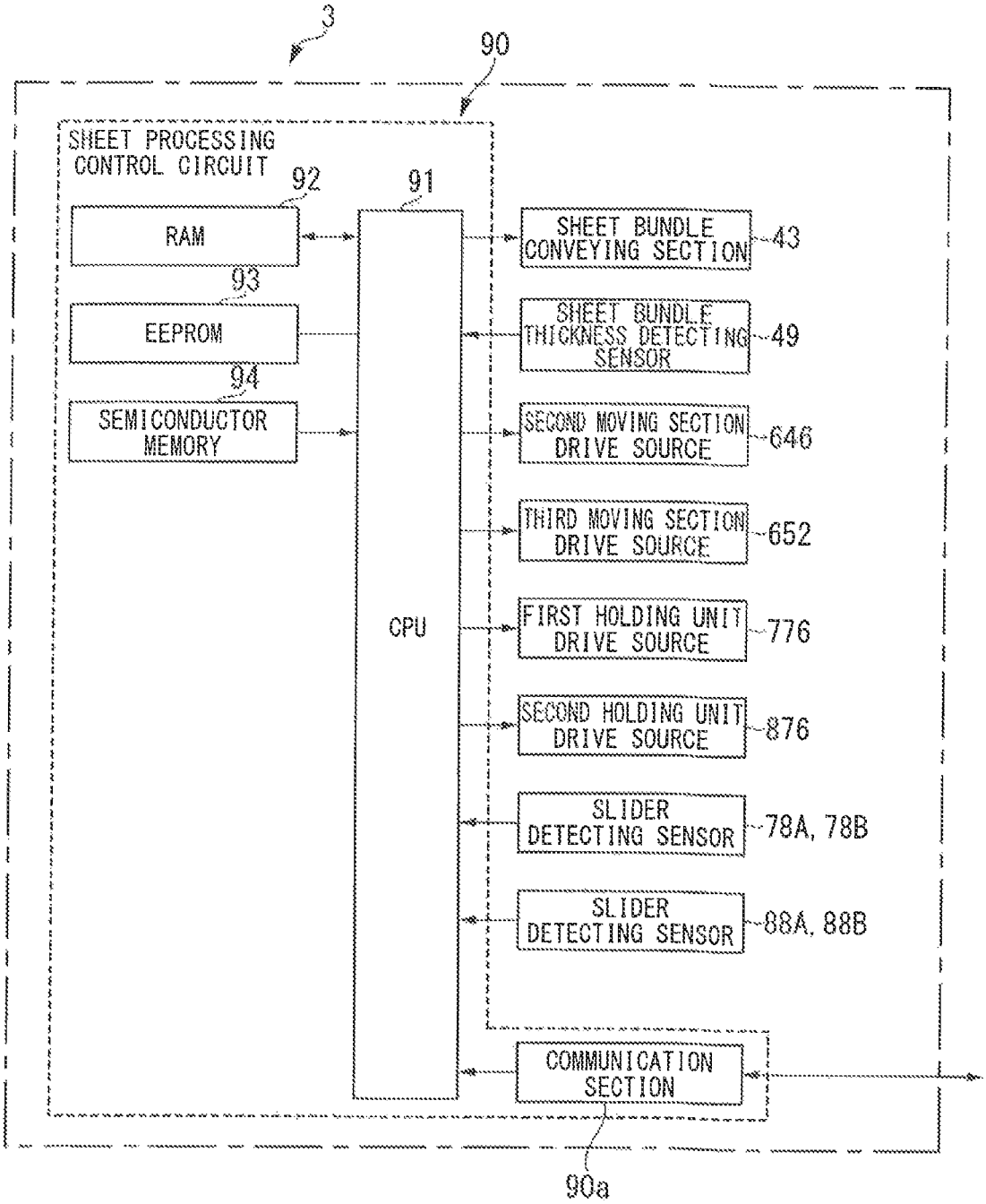
FIG. 15 is a block diagram of a sheet processing control circuit of the sheet processing apparatus of the present invention.

FIG. 15 is a block diagram of the sheet processing control circuit 90 of the sheet processing apparatus 3.

The sheet processing control circuit 90 includes, for example, a central processing unit (CPU) 91, a RAM 92 that is used as the work area of the CPU 91, an EEPROM 93 for storing the programs executed by the CPU 91 and the like, a semiconductor memory 91, and the communication section 90*a*. The sheet processing control circuit 90 is a concrete example of the controller of the present invention.

The CPU 91 is connected to the sheet bundle conveying section 43, a sheet bundle thickness detecting sensor 49, the second moving section drive source 646, and the third moving section drive source 652. Further, the CPU 91 is connected to the first holding unit drive source 276, the second holding unit drive source 876, and the slider detecting sensors 78A, 78B, 88A, 88B. The CPU 91 controls the whole sheet processing control circuit 90.

The communication section 90*a* functions both, as an interface and a communication tool for performing communication with the communication section 15*a* of the image forming apparatus 2 using a predetermined communication protocol. For example, TCP, UDP, serial communication or the like is used as the communication protocol. According to the instruction from the CPU 91, the communication section 90*a* transmits and receives input signal, control signal, and data between itself and the communication section 15*a* of the image forming apparatus 2.

The semi conductor memory 94 is a non-volatile storage such as a flash memory, and is adapted to store a table used to position the supporting places 61A, 61B, various programs, and sheet bundle thickness data of sheet bundle S2 obtained by the sheet bundle thickness detecting sensor 49. The CPU 91 reads out a program recorded in the EEPROM 93 or semiconductor memory 94, stores the readout program in tine RAM 35, and executes the program. For example, the CPU 91 executes a program stored in the RAM 92 to perform drive control of the third moving section drive source 652 according to the thickness of the sheet bundle S2.

[Operation of Composite Processing Section]

First, the operation of the composite processing section 37 (see FIG. 5) in the case where the square back processing and the trimming processing are both performed will be described below.

Figure 16A:
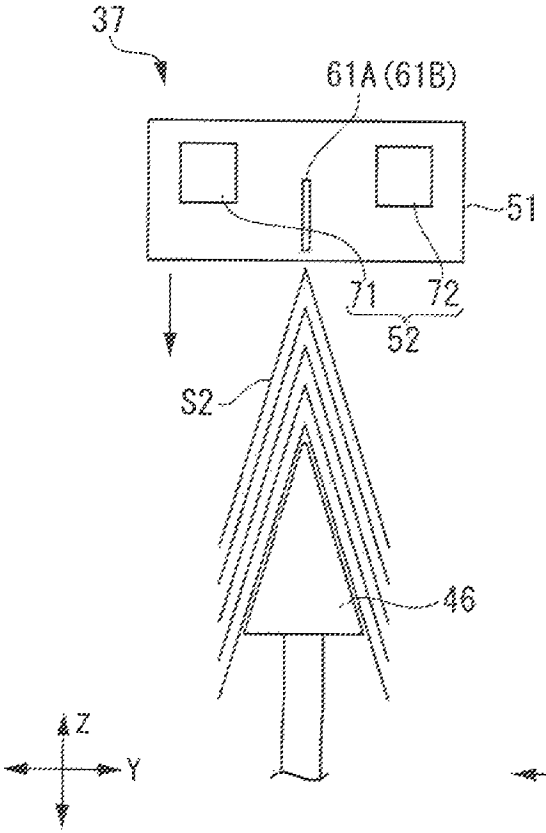
Figure 16B:
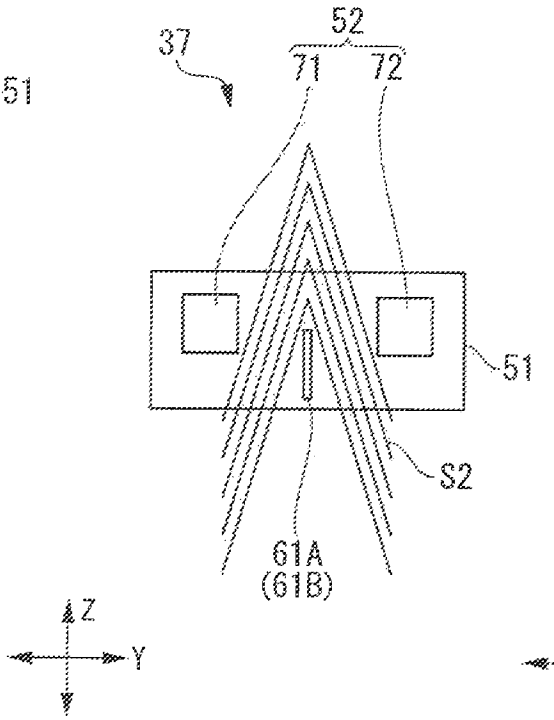
Figure 16C:
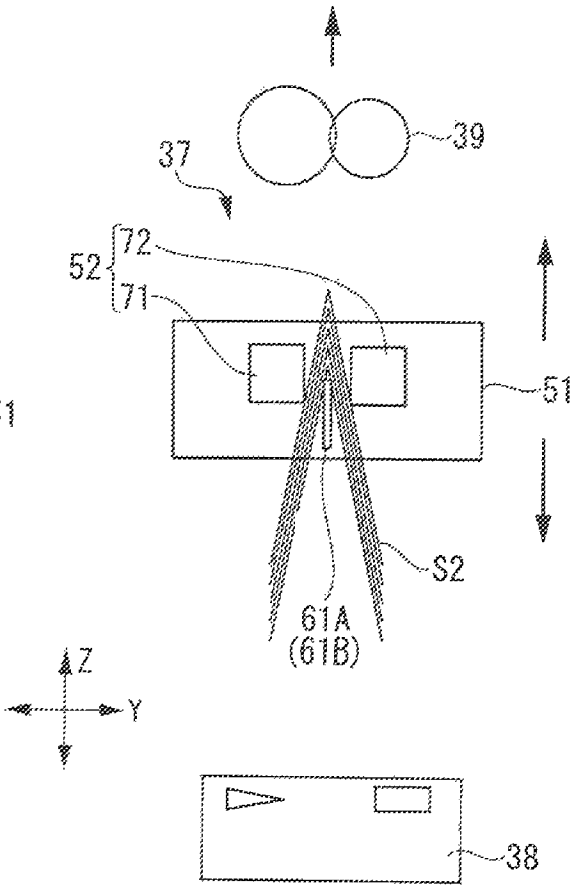

FIGS. 16A to 16C are schematic views for explaining fold aligning operation of the sheet bundle S2.

As shown in 16A, the sheet bundle S2 is placed on the sheet bundle placing member 46 of the sheet bundle conveying section 43 (see FIG. 4) and conveyed to a position immediately below the sheet bundle holding mechanism 51. At this time, the sheet bundle thickness detecting sensor 43 detects the thickness of the sheet bundle S2 placed on the sheet bundle placing member 46. An optical sensor, an ultrasonic sensor or the like, for example, can be used as the sheet bundle thickness detecting sensor 49.

When the sheet bundle S2 has been conveyed to the position immediately below the sheet bundle holding mechanism 51, the elevating mechanism 48 (see FIG. 5) is driven to lower the sheet bundle holding mechanism 51 to the receiving position, as shown in FIG. 16B. Thus, the sheet bundle S2 is inserted, from one end portion thereof where the fold is formed, into the opening 56 of the first holding unit 53 (see FIG. 12) and the opening 58 of the second holding unit 54 (see FIG. 14).

At this time, the pair of supporting plates 61A, 61B of the sheet bundle position aligning unit 52 are evacuated in positions facing the recessed surfaces 811*b* provided in the pressing member 81 of the second holding unit 54 (see FIG. 14). Thus, even if the sheet bundle holding mechanism 51 is lowered to the receiving position of the sheet bundle S2, the pair of supporting plates 61A, 61B will not interfere with the sheet bundle S2.

Next, the CPU 91 of the sheet processing control circuit 90 (see FIG. 15) controls the drive of the second moving section drive source 646 according to the length of the fold of the sheet bundle S2. Thus, the pair of supporting plates 61A, 61B are brought into positions below the inner side of the fold of the sheet bundle S2 and facing the both end portions of the fold.

Next, the CPU 91 of the sheet processing control circuit 90 controls the drive of the third moving section drive source 652 according to the thickness of the sheet bundle S2. Thus, the pair of supporting plates 61A, 61B are brought into suitable positions according to the thickness of the sheet bundle S2.

In order to form the folded portion of the sheet bundle S2 into a good square shape, it is necessary to adjust the length in the third direction Z of the folded portion of the sheet bundle S2 protruding upward from the pressing member 91 and receiving member 82 of the second holding unit 54 to a suitable value. In other words, the more the thickness of the sheet bundle S2 is increased, the more necessary it will be to increase the length in the third direction Z of the folded portion of the sheet bundle S2 protruding upward from the pressing member 81 and receiving member 82 to ensure the crashed amount of the folded portion of the sheet bundle S2.

The position of the sheet bundle S2 in the third direction Z with respect to the second holding unit 54 is determined according so the positions of the pair of supporting plates 61A, 61B abutting the inner side of the fold of the sheet bundle S2. Thus, in the present embodiment, the drive of the third moving section drive source 652 is controlled by the CPU 91 of the sheet processing control circuit 90 to bring the pair of supporting plates 61A, 61B into suitable positions according to the thickness of the sheet bundle S2.

Next, the sheet bundle holding mechanism 51 is raised by driving the elevating mechanism 48 (see FIG. 5). Thus, the pair or supporting plates 61A, 61B abuts against, the inner side or the fold of the sheet bundle S2 from below (see FIG. 8). Further, the horizontal-edge portions 61*a* (see FIG. 9) of the supporting plates 61A, 61B contact the inner side of the fold of the sheet bundle S2, and the vertical-edge portions 61*b* of the supporting plates 61A, 61B contact the both ends of the fold of the sheet bundle S2.

Thereafter, when the sheet bundle holding mechanism 51 is raised by driving the elevating mechanism 48, the pair of supporting plates 61A, 61B will lift the sheet bundle S2 in the vertical direction and support the sheet bundle S2.

Here, if the position of the fold of the sheet bundle S2 is deviated from the abutting positions of the pair of supporting plates 61A, 61B, the sheet bundle S2 will move to a position balanced between right and left due to its own weight while the sheet bundle S2 is being lifted. In other words, the sheet bundle S2 will move so that the fold thereof abuts the pair of supporting plates 61A, 61B. Thus, the position alignment of the fold of the sheet bundle S2 can be easily performed.

Incidentally, in order to reliably perform the position alignment of the fold of the sheet bundle S2, the sheet bundle holding mechanism 51 may also be moved up and down in the vertical direction for a plurality of times. Further, the position alignment of the fold of the sheet bundle S2 may also be performed by vibrating the pair of supporting plates 61A, 61B using a vibrating mechanism.

Next, as shown in FIG. 16C, the pressing member 71 is moved in the first direction Y by driving the first holding unit drive source 776 (see FIG. 12) of the first holding unit 53, so that the pressing member 71 is brought close to the receiving member 72. Thus, the sheet bundle S2 is held by the first holding unit 53 in a state where the position of the fold of the sheet bundle S2 has been aligned.

At this time, the pair of supporting plates 61A, 61B move in the first direction Y along with the sheet bundle S2 so as to be brought into the evacuation space formed between the pressing member 71 and the receiving member 72.

Next, the second moving section drive source 646 of the sheet bundle position aligning unit 52 is driven to move the pair of supporting plates 61A, 61B in the second direction X so that the pair of supporting plates 61A, 61B move away from each other. Thus, the pair of supporting plates 61A, 61B are evacuated in positions facing the recessed surfaces 811*b* of the pressing member 81 of the second holding unit 54 (see FIG. 14). As a result, the pair of supporting plates 61A, 61B are brought away from the folded portion of the sheet bundle S2. In other words, the sheet bundle S2 is held by the first holding unit 53 only.

Next, the pressing member 81 is moved in the first direction Y by driving the second holding unit drive source 876 of the second holding unit 54, so that the pressing member 81 is brought close to the receiving member 82. Thus, the vicinity of the folded portion of the sheet bundle S2 is held by the second holding unit 54.

Further, the length in the third direction Z of folded portion of the sheet bundle S2 protruding upward from the pressing member 81 and receiving member 82 becomes a suitable value corresponding to the thickness of the sheet bundle S2.

Next, the square back processing section 55 is driven to perform the square Pack processing on the folded portion of the sheet bundle S2. Thus, the folded portion of the sheet bundle S2 is formed into a back face having a good square shape.

After the square back processing is completed, the elevating mechanism 48 (see FIG. 5) is driven to lower the sheet bundle holding mechanism 51 by which the sheet bundle S2 is held, and thereby the sheet bundle S2 is brought into the processing position of the trimming section 38. Further, the trimming section 38 performs trimming processing on an end portion opposite to the folded portion of the sheet bundle S2. At this time, since the sheet bundle S2 is held in a state where the position of the fold thereof has been aligned, the sheet bundle S2 can be prevented from being out of alignment while performing the trimming processing.

Thereafter, the elevating mechanism 48 (see FIG. 5) is driven to raise the sheet bundle holding mechanism 51 by which the sheet bundle S2 is held. Further, the first holding unit 53 and the second holding unit 54 stop holding the sheet bundle S2, end the sheet bundle S2 is transferred to the ejecting section 39, so that the sheet bundle S2, which has been subjected to both the square back processing and the trimming processing, is ejected from ejecting section 39 to the outside of the apparatus.

In the aforesaid operation example of the composite processing section 37, the square back processing and the trimming processing are both performed. However, the composite processing section 37 is also adapted to perform only one of both the square back processing and the trimming processing. Incidentally, in the case where only the trimming processing is to be performed, the sheet bundle S2 needs not to be held by the second holding unit 54. Thus, in line case where only the trimming processing is to be performed, after the sheet bundle S2 has been held by the first holding unit 53, the sheet bundle holding mechanism 51 is lowered, and the sheet bundle S2 is brought into the processing position of the trimming section 38.

Note that, when performing the trimming processing, the position of the sheet bundle S2 in the third direction Z with respect to the first holding unit 53 is of the same importance as when performing the square back processing. The more the thickness of the sheet bundle S2 is increased, the more the misalignment of the plural sheets S1 in the end portion opposite to the folded portion of the sheet bundle S2 will be caused. Thus, the more the thickness of the sheet bundle S2 is increased, the mere necessary it will be to increase the trimming amount of the end portion opposite to the folded portion of the sheet bundle S2.

In the case where the sheet bundle holding mechanism 51 is lowered to bring the sheet bundle S2 into the processing position of the trimming section 38, the trimming amount of the cut portion opposite to the folded portion of the sheet bundle S2 is determined according to the position of the sheet bundle S2 in the third direction 2 with respect to the first holding unit 53. The position of the sheet bundle S2 in the third direction Z with respect to the first holding unit 53 is determined based on the positions of the pair of supporting plates 61A, 61B abutting the inner side of the fold of the sheet bundle S2.

Thus, in the present embodiment, the drive of the third moving section drive source 652 is controlled by the CPU 91 of the sheet processing control circuit 90 to bring the pair of supporting plates 61A, 61B into suitable positions corresponding to the thickness of the sheet bundle S2.

With the sheet processing apparatus and the image forming system according to the present embodiment, the position of the fold can be aligned easily by abutting the sheet bundle against the position aligning section. Further, when performing the trimming processing, the square back processing and/or the like, the end portion of the sheet bundle can be prevented from being out of alignment by holding the sheet bundle in a state where the position of the fold of the sheet bundle is aligned. Furthermore, the position of the sheet bundle can be adjusted with high accuracy corresponding to various processing.

In the present embodiment, the sheet bundle thickness detecting sensor 49 (see FIG. 15) detects the thickness of the sheet bundle S2 placed on the sheet bundle placing member 46 (see FIG. 4) of the sheet bundle conveying section 43. However, the detection of the thickness of the sheet bundle S2 according to the present invention may be performed at any stage, as long as it is performed before the sheet bundle S2 has been held by the first holding unit 53. For example, the detection of the thickness of the sheet bundle S2 may also be performed after the inner side of the fold of the sheet bundle S2 has abutted the pair of supporting plates 61A, 61B.

Further, in the present embodiment, the positron of the pair of supporting plates 61A, 61B in the third direction Z is controlled before the inner side of the fold of the sheet bundle S2 has abutted the pair of supporting plates 61A, 61B. However, the position adjustment of the pair of supporting plates 61A, 61B in the third direction Z according to the present invention may be performed at any stage, as long as it is performed before the sheet bundle S2 has been held by the first holding unit 53. For example, the position adjustment of the pair of supporting plates 61A, 61B may also be performed after the inner side of the fold of the sheet bundle S2 has abutted the pair of supporting plates 61A, 61B.

Further, in the present embodiment, the pair of supporting plates 61A, 61B abut the inner side of the fold of the sheet bundle S2 from above. However, the pair of supporting plates (i.e., the position aligning section) according to the present invention may abut the inner side of the fold of the sheet bundle S2 from any direction. For example, the pair of supporting plates may also abut the inner side of the fold of the sheet bundle S2 from the horizontal direction. In such as case, for example, the sheet bundle S2 is placed on a belt or rollers, and the end opposite to the folded portion of the sheet bundle S2 faces the horizontal direction.

Further, in the present embodiment, the drive source (motor), the drive pulley, the driven pulley, the conveying belt and the sliders used as the second moving section for moving the pair of supporting plates 61A, 61B in the second direction X. However, the second moving section according to the present invention may also be configured by, for example, a lineal motor for moving the first moving sections 63A, 63B in the second direction X.

Further, in the present embodiment, the sheet bundle position aligning unit 52 is integrated with the first holding unit 53. However, the sheet bundle position aligning unit according to the present invention rosy also be integrated with the second holding unit 54, or be separated from both the first holding unit 53 and the second holding unit 54.

Further, in the present embodiment, the sheet bundle holding mechanism 51 receives the sheet bundle S2 from a position above the sheet bundle placing member 46 in the third direction Z. However, the direction in which the sheet bundle S2 is received is not limited to the position above the sheet bundle placing member 46.

For example, the collected sheet bundle S2 may also be received from the horizontal direction, and after the sheet bundle S2 has been received, raising/lowering operation is performed to perform the position alignment operation to align position of the fold of the sheet bundle S2.

Or the sheet bundle S2 may be conveyed to a position above the sheet bundle holding mechanism 51, and the sheet bundle S2 is dropped toward a pair of supporting plates 61A, 61B from the above in the vertical direction. In such a case, since the fold of the sheet bundle S2 is caught on the pair of supporting plates 61A, 61B when drooping the sheet bundle S2, position alignment of the fold can be performed without moving up and down the pair of supporting plates 61A, 61B.

The present embodiment of the sheet processing apparatus and the image forming system and the advantages thereof are described above. It is to be understood that the sheet processing apparatus and the image forming system of the present invention is not limited to the embodiment described above, and various modifications and variations can be made without departing from the spirit and scope of the present invention.

Although the present embodiment is described based on an example in which the elevating mechanism and the lifting mechanism are integrated with each other, the present invention is not limited to such example. In other words, the lifting mechanism and the elevating mechanism may also be formed separately from each other, wherein the lifting mechanism is adapted to only move the position aligning unit having one position aligning section in the vertical direction, and the elevating mechanism is adapted to move the position aligning section and the holding section toward the side of the trimming section and the ejecting section.

Further, although the present embodiment is described based on an example in which a monochromatic image is formed, the present invention may also be applied to an image forming apparatus in which a plurality of image forming sections are provided to form a color image.

What is claimed is:

1. A sheet processing apparatus comprising:

a position aligning section adapted to be abutted against the inner side of a fold of a sheet bundle, which is formed by collecting a plurality of folded sheets, to thereby align the position of the folds of the plurality of folded sheets;

a holding section adapted to hold the sheet bundle in which the position of the folds of the plurality of sheets has been aligned by the position aligning section, while sandwiching the sheet bundle from a direction perpendicular to a direction along the fold of the sheet bundle;

a processing section adapted to perform a predetermined process on the sheet bundle held by the holding section;

a moving section adapted to move the position aligning section in the vertical direction; and a controller adapted to control the moving section, wherein, before the sheet bundle is held by the holding section, the controller controls to move the position aligning section to a position determined according to the thickness of the sheet bundle.

2. The sheet processing apparatus according to claim 1 further comprising: an elevating mechanism adapted to move up and down the position aligning section and the holding section, wherein the processing section is arranged above or below both the position aligning section and the holding section in the vertical direction.

3. The sheet processing apparatus according to claim 1, wherein the position aligning section supports the inner side of the fold of the sheet bundle from below.

4. The sheet processing apparatus according to claim 1, wherein the processing section performs a process for trimming an end portion of the sheet bundle held by the holding section.

5. The sheet processing apparatus according to claim 1, wherein the processing section performs a process for transforming a folded end portion of the sheet bundle held by the holding section into a square shape.

6. The sheet processing apparatus according to claim 1, wherein the moving section moves the position aligning section along the fold of the sheet bundle.

7. The sheet processing apparatus according to claim 1, wherein the moving section moves the position aligning section along the thickness direction of the sheet bundle.

8. An image forming system comprising:

an image forming section adapted to form an image on a sheet;

a folding section adapted to ford the sheet supplied from the image forming section; a position aligning section adapted to be abutted against the inner side of a fold of a sheet bundle, which is formed by collecting a plurality of folded sheets, to thereby align the position of the folds of the plurality of folded sheets;

a holding section adapted to hold the sheet bundle in which the position of the folds of the plurality of sheets has been aligned by the position aligning section, while sandwiching the sheet bundle from a direction perpendicular to a direction along the fold of the sheet bundle;

a processing section adapted to perform a predetermined process on the sheet bundle held by the holding section;

a moving section adapted to move the position aligning section in the vertical direction; and a controller adapted to control the moving section, wherein, before the sheet bundle is held by the holding section, the controller controls to move the position aligning section to a position determined according to the thickness of the sheet bundle.

9. The image forming system according to claim 8 further comprising: an elevating mechanism adapted to move up and down the position aligning section and the holding section, wherein the processing section is arranged above or below both the position aligning section and the holding section in the vertical direction.

10. The image forming system according to claim 8, wherein the position aligning section supports the inner side of the fold of the sheet bundle from below.

11. The image forming system according to claim 8, wherein the processing section performs a process for trimming an end portion of the sheet bundle held by the holding section.

12. The image forming system according to claim 8, wherein the processing section performs a process for transforming a folded end portion of the sheet bundle held by the holding section into a square shape.

13. The image forming system according to claim 8, wherein the moving section moves the position aligning section along the fold of the sheet bundle.

14. The image forming system according to claim 8, wherein the moving section moves the position aligning section along the thickness direction of the sheet bundle.

* * * * *